US012515913B2

(12) United States Patent
Skirrow

(10) Patent No.: US 12,515,913 B2
(45) **Date of Patent: *Jan. 6, 2026**

(54) METHODS AND SYSTEMS FOR AN AUTONOMOUSLY RETRACTING HOSE

(71) Applicant: Richard Skirrow, Austin, TX (US)

(72) Inventor: Richard Skirrow, Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/775,477

(22) Filed: Jul. 17, 2024

(65) Prior Publication Data

US 2024/0375909 A1 Nov. 14, 2024

Related U.S. Application Data

(63) Continuation of application No. 17/949,770, filed on Sep. 21, 2022, now Pat. No. 12,077,408, which is a continuation of application No. 17/735,231, filed on May 3, 2022, now abandoned.

(60) Provisional application No. 63/249,380, filed on Sep. 28, 2021.

(51) Int. Cl.
*B65H 75/44* (2006.01)
*E04H 4/16* (2006.01)

(52) U.S. Cl.
CPC ..... *B65H 75/4489* (2013.01); *B65H 75/4402* (2013.01); *E04H 4/1654* (2013.01); *B65H 2701/33* (2013.01)

(58) Field of Classification Search
CPC ..... B65H 75/4478; B65H 75/4489; E04H 4/1672; E04H 4/1681
See application file for complete search history.

(56) References Cited

U.S. PATENT DOCUMENTS 3,910,497 A * 10/1975 Manor ..... B05B 9/0403 239/722
3,939,862 A * 2/1976 Booth ..... B65H 75/4471 137/355.19
4,449,260 A * 5/1984 Whitaker ..... E04H 4/1681 4/492
7,441,284 B2 * 10/2008 Pansini ..... E04H 4/1654 137/355.16
12,077,408 B2 * 9/2024 Skirrow ..... B65H 75/4489
2006/0169322 A1 * 8/2006 Torkelson ..... E04H 4/1681 137/355.2

* cited by examiner

*Primary Examiner* — Kevin F Murphy

(57) ABSTRACT

A swimming pool cleaner coupled to a hose, wherein the hose is configured to automatically extend and retract.

10 Claims, 22 Drawing Sheets

METHODS AND SYSTEMS FOR AN AUTONOMOUSLY RETRACTING HOSE

BACKGROUND INFORMATION

Field of the Disclosure

Examples of the present disclosure relate to a swimming pool cleaner coupled to a hose, wherein the hose is configured to automatically extend and retract based on fluid flowing through a pool connect turbine assembly. More specifically, the flowing fluid may cause an assembly spool to rotate in a first direction, ceasing the flow of fluid then restarting the flow of fluid may rotate a valve from a first position to a second position, and the flowing fluid may cause the assembly spool to rotate in a second direction.

Background

Keeping a swimming pool clean and clear is a major part of being a pool owner. Pool cleaners are self-contained devices that are configured to automatically clean a pool. Pool cleaners may be contain their own internal battery, utilize a suction line, and/or utilize a return side of the pool. Pressure side pool cleaners are those that attached to the pressure side, via the return line, of a pool's circulation system. Fluid pumped into the pool propels these units. Vacuum side pool cleaners utilize a suction force that is created by removing fluid from the pool via a vacuum line. Conventional pool cleaners utilize a hose associated with a first end coupled to the return/suction line, and a second side coupled with the pool cleaner. However, after conventional pressure side pool cleaners are finished cleaning the pool, the hose and pool cleaner remain in the pool. This creates unwanted obstacles, hazards, etc. within the pool that requires manual removal of the pool cleaner and the hose after each use.

Accordingly need exist for systems and methods associated with pool cleaner with a housing that is configured to be mounted within or on a pool wall, wherein the hose extends based on fluid flowing through a pool connect turbine assembly, and the system also automatically retracts the hose utilizing the flow of fluid through the pool connect turbine assembly.

SUMMARY

Embodiments disclosed herein describe a system that autonomously stores a hose in a reel and automatically retracts a pool cleaner. In embodiments, fluid may enter the system under pressure or suction from a pool pump. The flow of fluid may cause a turbine to rotate, converting the linear flow of fluid into rotational motion. The flow of fluid may hydraulically move the pool cleaner within the pool, extending the hose from the reel and rotating the reel in a first direction. After the pool cleaner has cleaned the pool, the flow of fluid may cease. Responsive to restarting the flow of fluid from the pool pump, a valve, embedded within the reel may rotate, allowing the flow of fluid to rotate the reel in a second direction. In other embodiments, the rotational motion winds a spring coil. Further, while the fluid is flowing through the system, a hose may unreel. Responsive to ceasing the flow of fluid, the energy stored by the spring coil may cause the hose reel to automatically retract, and pull the pool cleaner to a position adjacent to the reel on the side of pool or into a docking station. In a first embodiment, the system may include a pool with a line, housing, center pivot, hose, and pool cleaner.

The line may be configured to carry pool water from a pump to an outlet, or vice versa. The line may be configured to move fluid from a filtration system back into the pool. In embodiments, the line may be positioned on a sidewall of the pool, on a skimmer, or any other pump.

The housing may be a device that is configured to be coupled with the line and the hose. In embodiments, the housing may be surface mounted onto the sidewall of the pool or be positioned within a recess within the pool wall. The housing may include a pool connector, inner casing, spring, spindle supply line, center pivot, feeder arm, and a hose opening.

The pool connector may include an inlet, turbine, and outlet. The inlet of the pool connector may fluidly connect the housing to the line, such that the housing may receive fluid. Responsive to fluid entering the inlet, a turbine within the pool connector may rotate to convert directional flow into rotational movement. The rotational movement of the turbine may rotate an inner casing, or directly wind/unwind a reel, with or without a gear, which may in turn wind the spring, compress a hydraulic chamber, or store energy via other known means.

As the spring is winding, fluid may flow out of the outlet of the pool connector to the center pivot via the spindle supply line. The center pivot may be a rotation of axis of a feeder arm. The feeder arm may be configured to extend from the center spindle through an opening of the inner casing, and may rotate about the center pivot and transfer fluid from the center spindle into the hose. When the feeder arm is supplying fluid to the hose, the feeder arm may be configured to rotate in a first direction. Responsive to ceasing the flow of fluid through feeder arm, the inner casing may apply pressure against the feeder arm via the spring to rotate the feeder arm, and the inner casing, in a second direction. In embodiments, a turbine, with or without gears or a spring, could act on the inner casing or the center spindle.

The hose opening may be positioned on an outer surface of the housing, and may allow more or less of the hose to be positioned within the housing.

The hose may be a buoyant hose that is configured to carry fluid from the feeder arm to the pool cleaner. The hose may be any type of flexible hollow tube, which can be wrapped around the inner casing when not in use. In embodiments, responsive to the fluid flowing out of the feeder arm the hose may be extend, which may push the pool cleaner. Responsive to fluid no longer flowing through the pool connector, the spring may release its stored energy and automatically retract the hose.

The pool cleaner may be a device that is configured to collect debris and sediment from the swimming pool. The pool cleaner may be configured to move around the pool based on the fluid flowing through the hose. When the hose is extended from the housing, then the pool cleaner may move further away from the housing. When the hose is retracted, the pool cleaner may automatically move towards a docking station or a position proximate to the housing. Therefore, embodiments do not require the manual removable of the pool cleaner from the pool in order for it to be out of the way, the pool cleaner will automatically be pulled by the hose to a location proximate to the housing.

A second embodiment may include a propulsion drum, ported outlet, spring, sliding valve, hose connect arm, at least one winding arm, and an unwinding arm.

The propulsion drum may be configured to be coupled to a return or supply side of a pool pump. The propulsion drum may have a first face that is configured to be mounted flush to a surface of a pool or other support structure, wherein the propulsion drum may be submerged or partially submerged within the pool. The propulsion drum may be configured to rotate in a first direction and a second direction based on fluid flowing through the center pivot, wherein the propulsion drum rotates in both the first direction and the second direction when fluid is flowing from a proximal end to a distal end of the center pivot, or vice versa.

The propulsion drum may include a center pivot, which includes a fixed portion and a ported outlet. The center pivot may be configured to mechanically couple the first face and the second face of the propulsion drum, wherein the center pivot is positioned between the first face and the second face. The fixed portion may be configured to be coupled to a fixed support arm within the first face, and may not rotate. An inner face of the fixed portion of the center pivot may include pivot body grooves. The ported outlet may be configured to rotate based on fluid flowing out of the at least one winding arm, and an unwinding arm.

The ported outlet may be a housing, body, etc. that is substantially tubular in shape, and be coupled to a fixed portion of the center pivot. The ported outlet may have a plurality of outlet ports that extend from an inner circumference of the ported outlet to the outer circumference of the ported outlet. In embodiments, two of the plurality of the ports may be coupled to the winding arms, one of the plurality of ports may be coupled to the unwinding arm, and one of the plurality of ports may be coupled to hose connect arm. In embodiments, based on the rotational positioning of the sliding valve, the sliding valve may be in a first mode and the ported outlet may communicate fluid to the windings arms to rotate the ported outlet in a first direction to wind the hose. Alternatively, the sliding valve may be in a second mode and the ported outlet may communicate fluid to the unwinding arm and the hose connect arm to rotate the ported outlet in a second direction to unwind the hose and move the pool cleaner.

The sliding valve may be configured to be positioned within the ported outlet, wherein the sliding valve is configured to rotate to between a first mode and a second mode. The sliding valve may rotate while the ported outlet is stationary. The sliding valve may have a plurality of valve ports, wherein a number of the valve ports is less than a number of the outlet ports, wherein the valve ports may be positioned on opposite sides of the sliding valve. In embodiments, in the first mode the valve ports may be aligned with the windings arms, and the unwinding arm and the hose connect arm may be blocked by the sidewalls of the sliding valve. This may enable fluid to flow within the sliding valve and ported outlet into the winding arm to rotate the drum in a first direction. In the second mode, the valve ports may be aligned with the unwinding arm and the hose connect arm and the winding arms may be blocked by the sidewalls of the sliding valve. This may enable fluid to flow within the sliding valve and the ported outlet into the unwinding arm and to the pool cleaner.

In embodiments, the sliding valve may include a first open face and a second closed face. The first open face may be configured to allow fluid to flow pass through the sliding valve and out of the valve ports. In embodiments, the pegs, projections, etc. positioned on an outer circumference of the sliding valve that are configured to selectively engage with the pivot body grooves by rotating the sliding valve. More specifically, the pegs may configured to interface with the pivot body grooves embedded within the ported outlet to assist in rotation of the sliding valve and secure the sliding valve in place, wherein the pivot body grooves remain stationary while the sliding valve rotates based on the interfacing of the pegs with the grooves.

The closed face may be configured to restrict fluid from flowing out of the sliding valve, wherein the closed face allows hydraulic forces to act upon an inner surface of the closed face, and the spring to act upon an outer surface of the closed face. The closed face may be positioned adjacent to the spring. The spring may be configured to apply a constant force against the closed face towards a lower surface of the pivot body grooves.

In embodiments, responsive to flowing fluid into the sliding valve, the fluid may cause a hydraulic force to overcome the spring force to engage the pegs with an upper surface of the pivot body grooves, which may align the valve ports with selective ports of the ported outlet. Responsive to ceasing the flow of fluid, the spring force may be greater than the nulled hydraulic force, which may push the pegs towards a lower surface the pivot body grooves. Due to the profiles of the pivot body grooves and the pegs and the elongation of the spring, the sliding valve may rotate. This cycle of flowing fluid and ceasing flowing of fluid, may move the sliding valve between the first mode to the second mode. Responsive to flowing fluid and subsequently ceasing the flow of fluid, the sliding valve may rotate from the second mode to the first mode.

However, in other embodiments, other mechanisms may be utilized to rotate the sliding valve, wherein the sliding valve may rotate based on the profile associated with the sliding valve and pivot body grooves interfacing together due to compressive forces of the spring and the releasing of the spring forces.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

FIG. 11 depicts various layouts of turbines and gears within pool connectors, according to embodiments.

Figure 1:
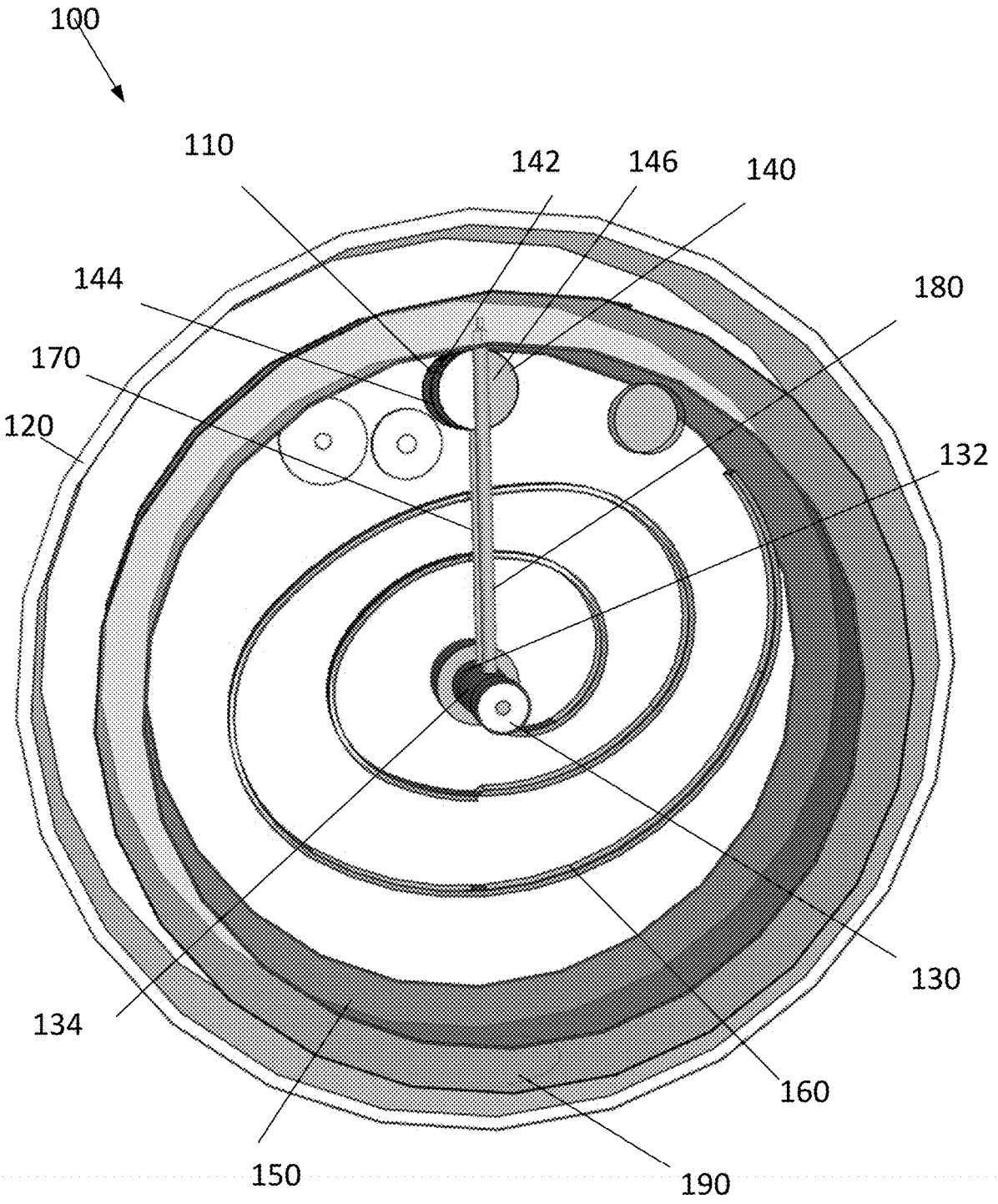
FIG. 1 depicts an autonomous pool cleaning system, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

FIG. 1 depicts an autonomous pool cleaning system 100, according to an embodiment. Autonomous pool cleaning system 100 may include a line 110, housing 120, hose (not shown in FIG. 1), and pool cleaner (not shown in FIG. 1).

Line 110 may be configured to carry pool water from a pump or skimmer to an outlet. The line 110 may be configured to move fluid from a filtration system back into the pool. Alternatively, line 110 may be associated with a suction line, and configured to remove fluid from the pool. In embodiments, the line 110 may be positioned on a sidewall of the pool.

Housing 120 may be a device that is configured to be coupled with the line 110 and the hose, and retain and protect the other elements of system 100. Housing 120 may be flush mounted onto the sidewall of the pool, be positioned within a recess within the pool wall, or be positioned within a deck. Housing 120 may include a pool connector 140, inner casing 150, spring 160, spindle supply line 170, center pivot 130, feeder arm 180, and a hose opening 190.

Pool connector 140 may include an inlet 142, turbine 144, and outlet 146. Pool connector 140 may be configured to receive fluid from the line 110 and transfer the fluid to the hose. While the fluid is moving through pool connector 140, turbine 144 may rotate, which may cause spring 160 to coil and store energy.

Inlet 142 may be configured to fluidly connect housing 140 to the line 110, such that housing 140 may receive fluid. Responsive to fluid flowing between inlet 142 and outlet 146, turbine 144 within the pool connector 140 may rotate to convert directional flow into rotational movement.

Turbine 144 may be positioned between inlet 142 and outlet 146, and may be configured to rotate while inlet 142 and outlet 146 remain stationary. In embodiments, turbine 144 may rotate responsive to fluid flowing from inlet 142 towards outlet 146 or from outlet 146 towards 142. As such, pool connector 140 may be configured to operate with either a return line pool cleaner or a suction based pool cleaner.

Inner casing 150 may be configured to rotate in a first direction to coil spring 160 and to elongate the hose, and inner casing 150 may be configured to rotate in a second direction based on energy supplied from spring 160 and to retract the hose. Inner casing 150 may include an outer face that is configured to allow the hose to be reeled along the outer surface of inner casing 150 when stored. Inner casing 150 may also include an inner surface that is configured to receive and transfer forces to spring 160. Additionally, inner casing 150 may include an orifice where feeder arm 180 can be extended through. The rim created by the orifice transfers forces to feeder arm 180 to allow feeder arm 180 to correspondingly and automatically rotate in the first direction and the second direction.

Spring 160 may be a mechanical device configured to store and release energy. Spring 160 may be configured to apply a constant spring force against inner casing 150. Spring 160 may be configured to be coiled to store energy when the pressure applied against spring 160 a first direction is greater than the spring force. Specifically, turbine 144 may directly or indirectly rotate inner casing 150 based on fluid flowing through pool connector 140. If the rotational forces generated by turbine 144 are greater than the constant spring force, spring 160 may coil to store energy. Responsive to removing the forces created by turbine 144, such that the forces applied against spring 160 are less than the constant spring force, spring 160 may automatically release the stored energy. This release of energy may rotate inner casing 150 in a second direction. In other embodiments, spring 160 may be any device that is configured to store energy, such as hydraulic chambers pneumatic chambers, etc. In embodiments, spring 160 may be positioned at any desirable location within housing 120. For example, spring 160 may be positioned within pool connector 140, within center pivot 130, around center pivot 130 within housing, etc.

Spindle supply line 170 may be a device that is configured to transfer fluid between outlet 146 and center pivot 130.

Spindle supply line 170 may be a fixed element that is configured to remain stationary.

Center pivot 130 may be positioned centrally within housing 120. Central pivot 130 may be configured to provide an axis of rotation to feeder arm 180, and allow fluid transfer between spindle supply line 170 and feeder arm 180. Center pivot 130 may include a first portion 132 and a second portion 134. First portion 132 may be a fixed portion of center pivot and may not rotate. In embodiments, first portion 132 may be positioned between a pool sidewall and second portion 134. Second portion 134 of center pivot 130 may be a rotating portion of center pivot 130, and second portion 134 may be positioned in front of first portion 132.

Feeder arm 180 may be configured to rotate along with second portion 134 of center pivot 130. Feeder arm 180 may include a first end positioned within center pivot 130 and a second end positioned outside of inner casing 150 within housing 120, wherein the second end of feeder arm 180 may transfer fluid to a hose connection. In embodiments, the second end of feeder arm 180 may be configured to be inserted through a hole within inner casing 150, wherein a rim of the hole within inner casing 150 may apply rotational forces against feeder arm 180, wherein the rotational forces are generated based on fluid flowing through pool connector 140. Responsive to inner casing 150 rotating in a first direction, feeder arm 180 may rotate in a first direction. Responsive to inner casing 150 rotating in a second direction, feeder arm 180 may rotate in the second direction. Accordingly, the rotational movement of the turbine 144 within pool connector 140 may rotate an inner casing 150 and feeder arm 180 in a first direction, which may in turn wind spring 160. Responsive to the turbine 144 within pool connector 140 no longer turning inner casing 150 in the first direction, spring 160 may apply forces against inner casing 150 to turn inner casing 150 and feeder arm 180 in the second direction.

Hose opening 190 may be a hole positioned through a sidewall of housing 120. Hose opening 190 may be configured to allow the hose to be extended and retracted from housing 120 based on forces generated by fluid flowing through pool connector 140 and forces generated by spring 160. In embodiments, hose opening 190 may be positioned at a bottom apex of housing, or at any other desirable location within housing 120.

The hose may be a buoyant hose that is configured to carry fluid from the feeder arm to the pool cleaner. The hose may be any type of flexible hollow tube, which can be wrapped around the inner casing 150 when not in use. In embodiments, responsive to the fluid flowing out of the feeder arm 180 the hose may be extend, which may push the pool cleaner. Responsive to fluid no longer flowing through the pool connector, the spring 160 may release its stored energy and automatically retract the hose.

The pool cleaner may be a device that is configured to collect debris and sediment from the swimming pool. The pool cleaner may be configured to move around the pool based on the movement of the hose. When the hose is extended from the housing, then the pool cleaner may move further away from the housing. When the hose is retracted, the pool cleaner may automatically move towards a docking station or a position proximate to the housing. Therefore, embodiments do not require the manual removable of the pool cleaner from the pool in order for it to be out of the way, the pool cleaner will automatically be pulled by the hose to a location proximate to the housing 120.

Figure 2:
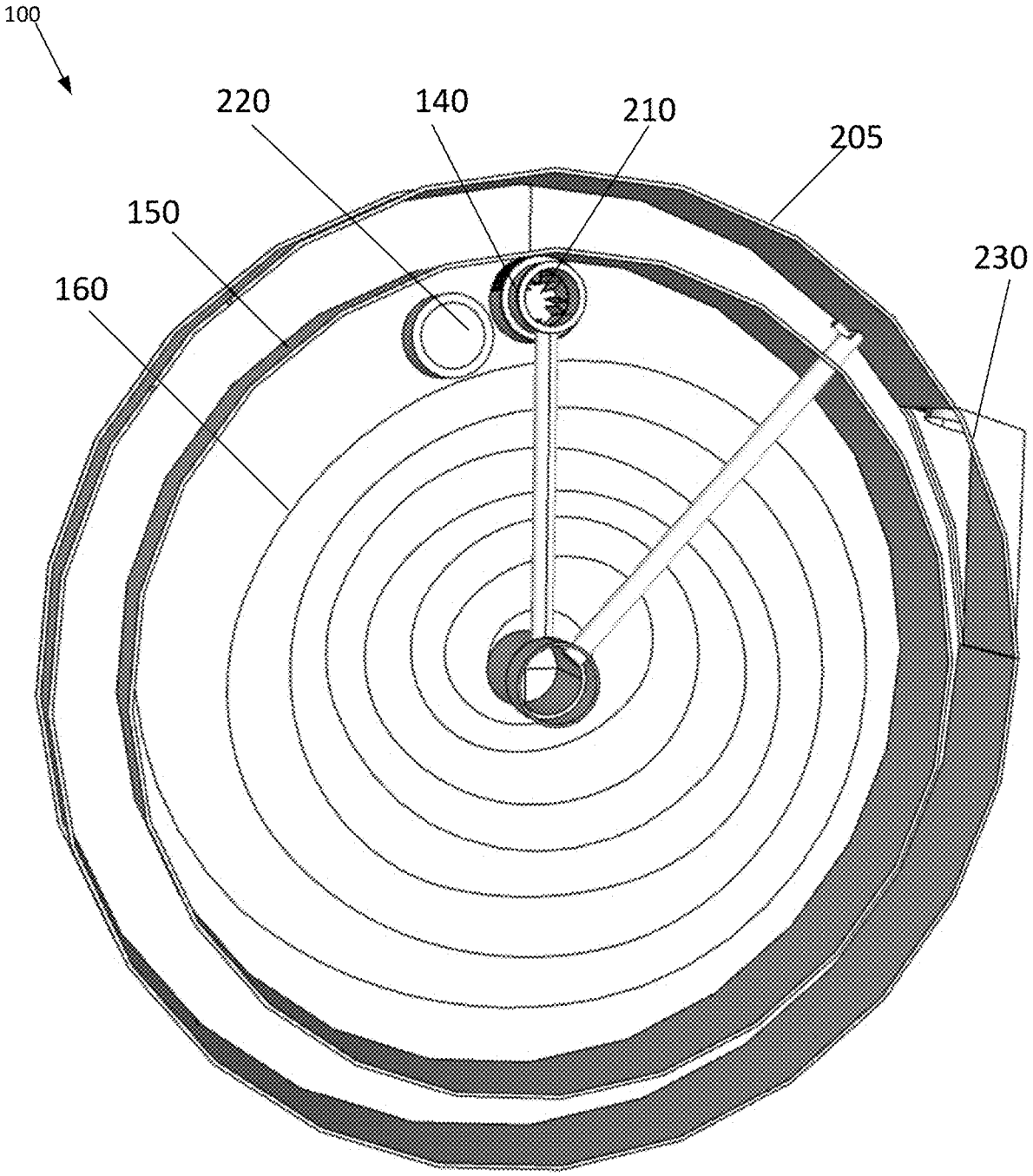
FIG. 2 depicts a front view of an autonomous pool cleaning system, according to an embodiment.

FIG. 2 depicts a front view of system 100, according to an embodiment. FIG. 2 depicts elements described above, and for the sake of brevity a further description of these elements may be omitted.

As depicted in FIG. 2, pool connector 140 may have a plurality of turbines 210 positioned on the inner circumference of pool connector 140. The plurality of turbines 140 may be angled longitudinally and laterally to efficiently interface with fluid flowing through pool connector 140.

Furthermore, at least one gear 220 may be coupled to spring 160 and or inner casing 150, At least one gear 200 may be configured to assist in winding or uncoiling spring 160, or may assist in rotating inner casing 150 in the first direction or the second direction. In other embodiments, the at least one gear 220 may assist in storing energy to rotate inner casing 150 in the first direction of the second direction.

System 100 may also include a hose entry point 230. Hose entry point 230 may include bearings, lubricants, etc. which may assist in inserting or removing the hose from housing 120.

Figure 3:
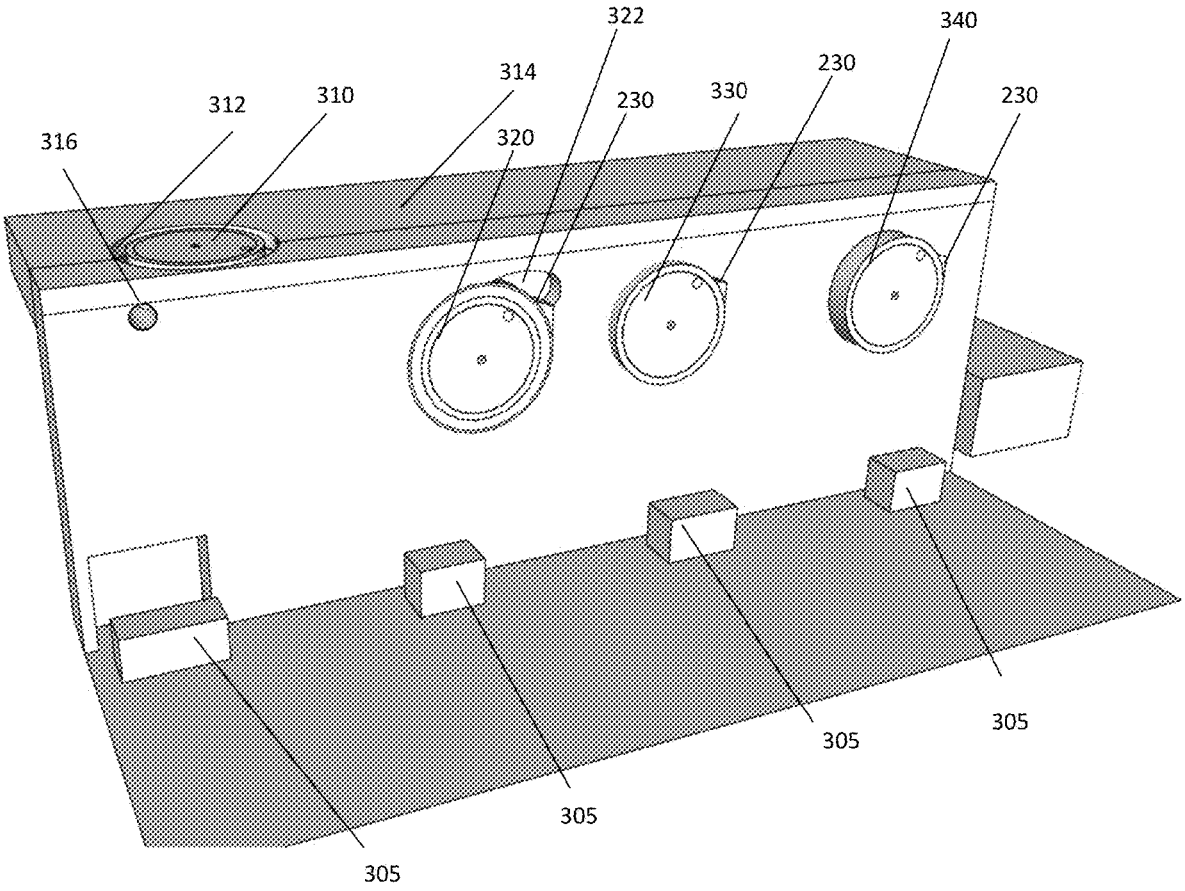
FIG. 3 depicts various installation configurations of an autonomous pool cleaning system, according to embodiments.

FIG. 3 depicts various installation configurations of system 100, according to embodiments. Elements depicted in FIG. 3 may be described above, and for the sake of brevity a further description of these elements may be omitted. As depicted in FIG. 3, system 100 may be installed in a first configuration 310, second configuration 320, third configuration 330, or fourth configuration 340. Each of the configurations 310, 320, 330, 340 may be configured to autonomously control a pool cleaner 305.

In the first configuration 310, system 100 may be deck 314 mounted within a recess 312 within the deck 314. The recess 312 may include an access panel that is positioned flush over system 100. Furthermore, a hose entry port 316 may be positioned on a sidewall of the pool.

In the second configuration 320, system 100 may be positioned fully within a recess 322 on the sidewall of the pool. A niche 324 may be positioned within the recess 322, which allows the hose to be extended and retracted.

In the third configuration 330, system 100 may be partially recessed within the sidewall of the pool. Due to the partial recession of system 100 in the third configuration 330, hose entry point 230 may be exposed. This may the hose to be extended and retracted.

In the third configuration 330, system 100 may be mounted on the sidewall of the pool, such that hose entry point 230 is exposed.

Figure 4:
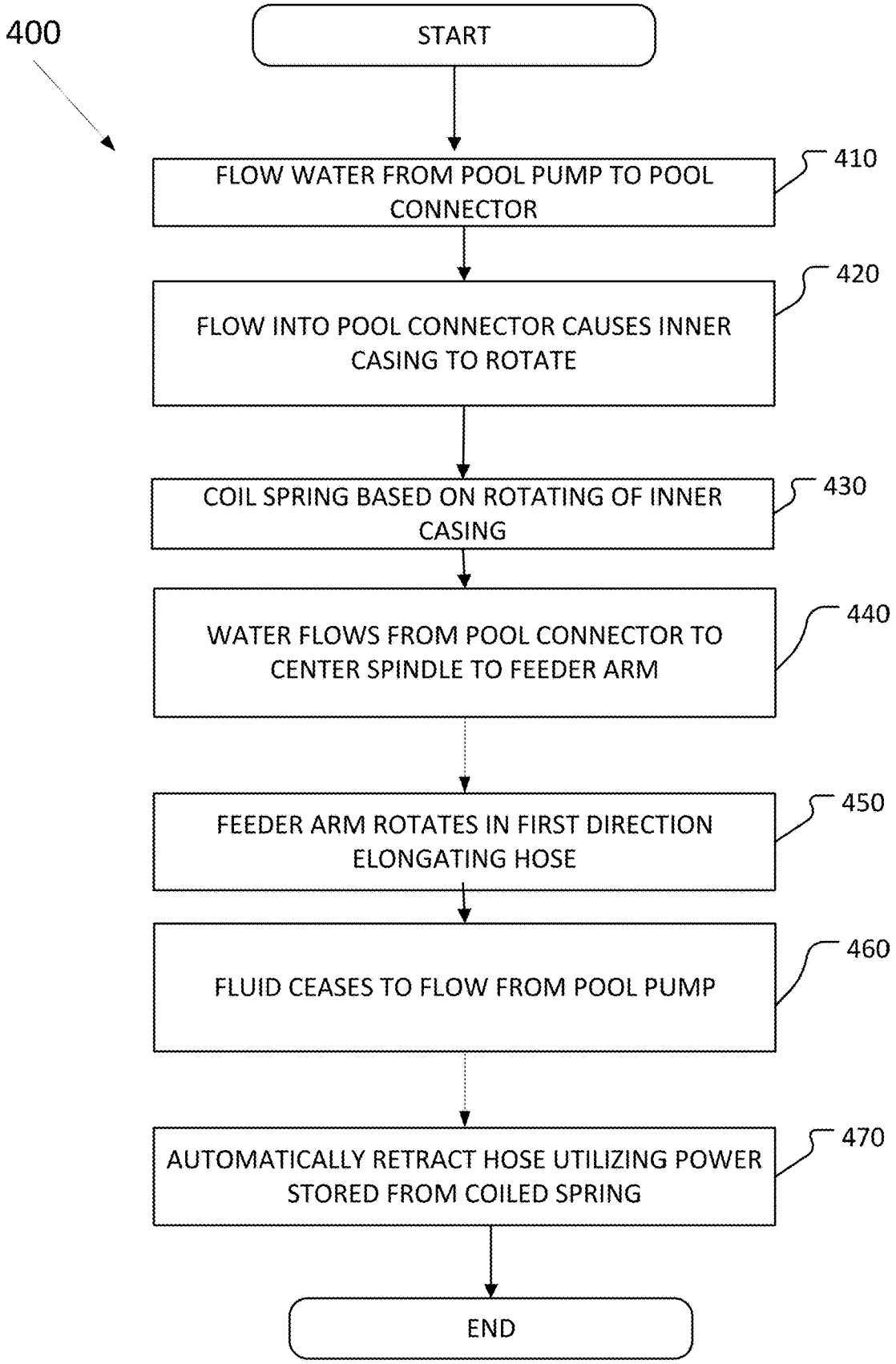
FIG. 4 depicts a method for utilizing an autonomous system associated with a pool cleaner, according to an embodiment.

FIG. 4 depicts a method 400 for utilizing an autonomous system associated with a pool cleaner, according to an embodiment. The operations of method 400 presented below are intended to be illustrative. In some embodiments, method 400 may be accomplished with one or more additional operations not described, and/or without one or more of the operations discussed. Additionally, the order in which the operations of method 400 are illustrated in FIG. 4 and described below is not intended to be limiting.

At operation 410, fluid may flow through a pool connector. The fluid may flow in either a suction direction or a pressurized direction, wherein the fluid flows in a linear direction.

At operation 420, the linear flow of fluid causes a turbine within a pool connector to rotate. The rotation of the turbine may also correspond rotate an inner casing.

At operation 430, the rotation of the turbine causes a spring to coil, and store energy.

At operation 440, the flowing fluid may flow through the pool connector, into a center spindle that forms an axis of rotation of the inner casing and to a feeder arm. The outlet of the feeder arm may be positioned between the inner casing and a housing of the system.

At operation 450, rotation of the inner casing may cause the feeder arm to rotate in a first direction. The rotation of the feeder arm may allow a hose to elongate from the housing, such that more of the hose is exposed to a body of the pool. The elongation of the hose may move a pool cleaner.

At operation 460, the fluid may cease flowing through the pool connector.

At operation 470, the spring may release the stored energy due to the spring force being greater than the fluid flow force due to the cessation of the fluid flow. Responsive to the spring releasing the stored energy, the spring may apply forces against the inner casing to rotate the casing in a second direction, which may in turn rotate the feeder arm in the second direction and automatically retract the hose.

Figure 5:
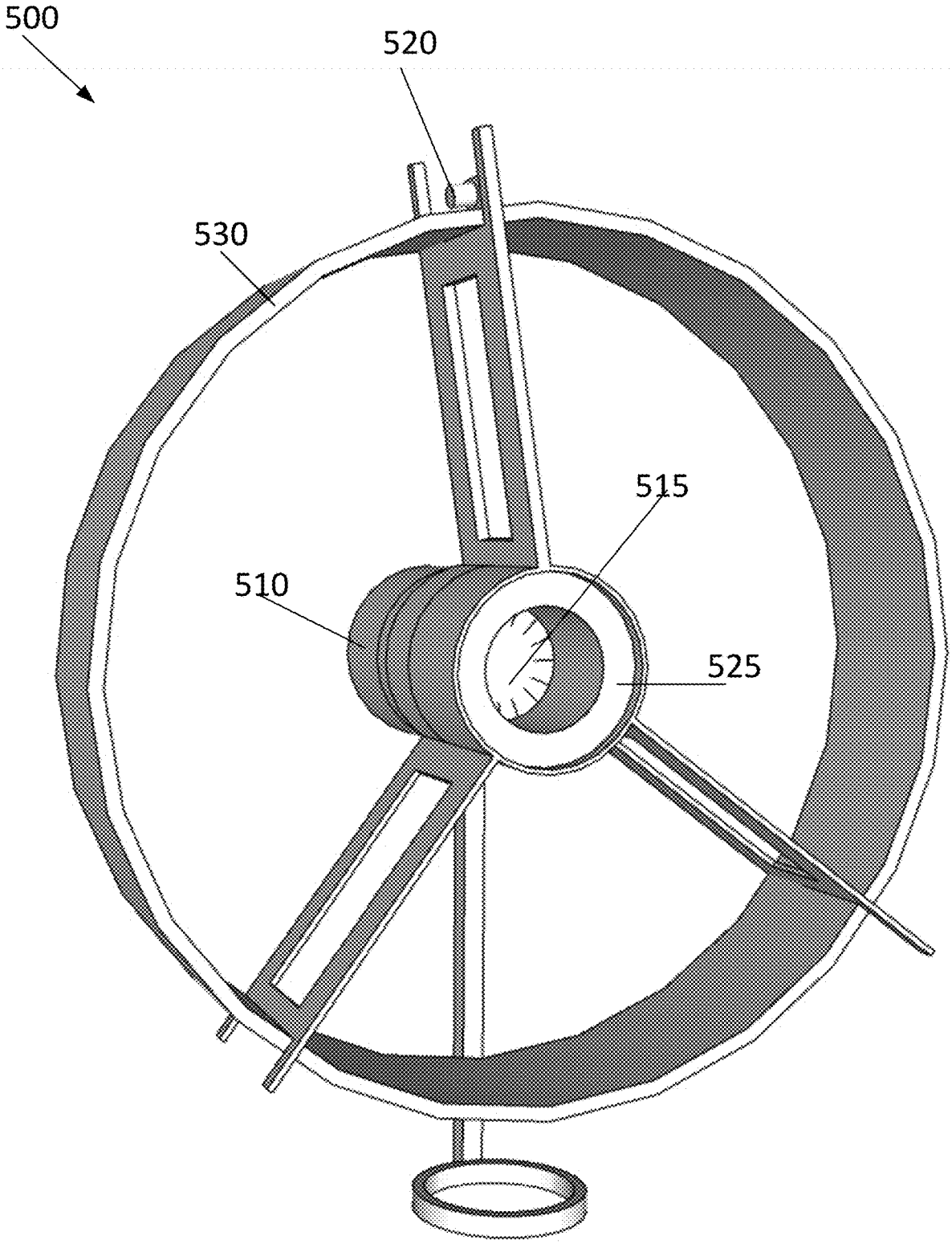
FIG. 5 depicts an alternative embodiment of an autonomous pool cleaning system to automatically extend and retract a hose.

FIG. 5 depicts an alternative embodiment of a system 500 to automatically extend and retract a hose. Elements depicted in FIG. 5 may be described above, and for the sake of brevity a further description of these elements may be omitted.

As depicted in FIG. 5, a pool connector 510 with turbines 515 may be positioned at an axis of rotation of a hose connect 520. Furthermore, a coil spring 525 may be embedded within the pool connector 510. When fluid flows through the pool connector 510, turbines 515 may rotate a rotating part of pool connector 510, which may coil spring 525 and rotate hose connect 520. Hose connect 520 may rotate along with a rotating hose ring 530.

Figure 6:
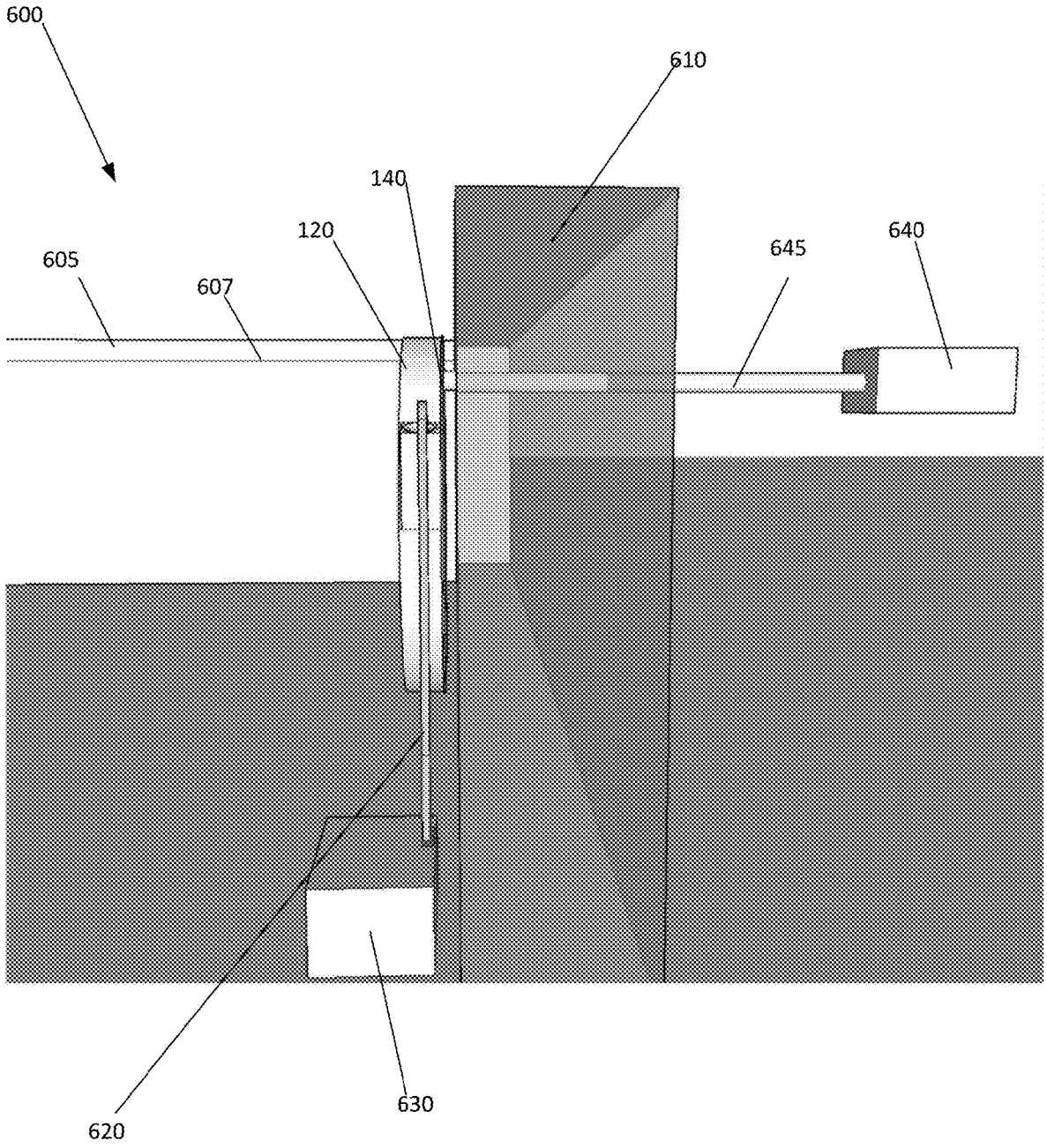
FIG. 6 depicts an autonomous pool cleaning system mounted on a sidewall of a pool, according to an embodiment.

FIG. 6 depicts a system 100 mounted on a sidewall of a pool 610, according to an embodiment. Elements depicted in FIG. 6 may be described above, and for the sake of brevity a further description of the elements may be omitted.

As depicted in FIG. 6, a pump 640 may be configured to communicate fluid to or from pool connector 140. Pump 640 may be configured to supply fluid to pool connector 140 via return line 645, or pump 640 may be configured to receive fluid via suction line 645.

Furthermore, housing 120 may be positioned below or even with pool coping 605, which that a portion of housing 120 may be positioned above a water line.

Figure 7:
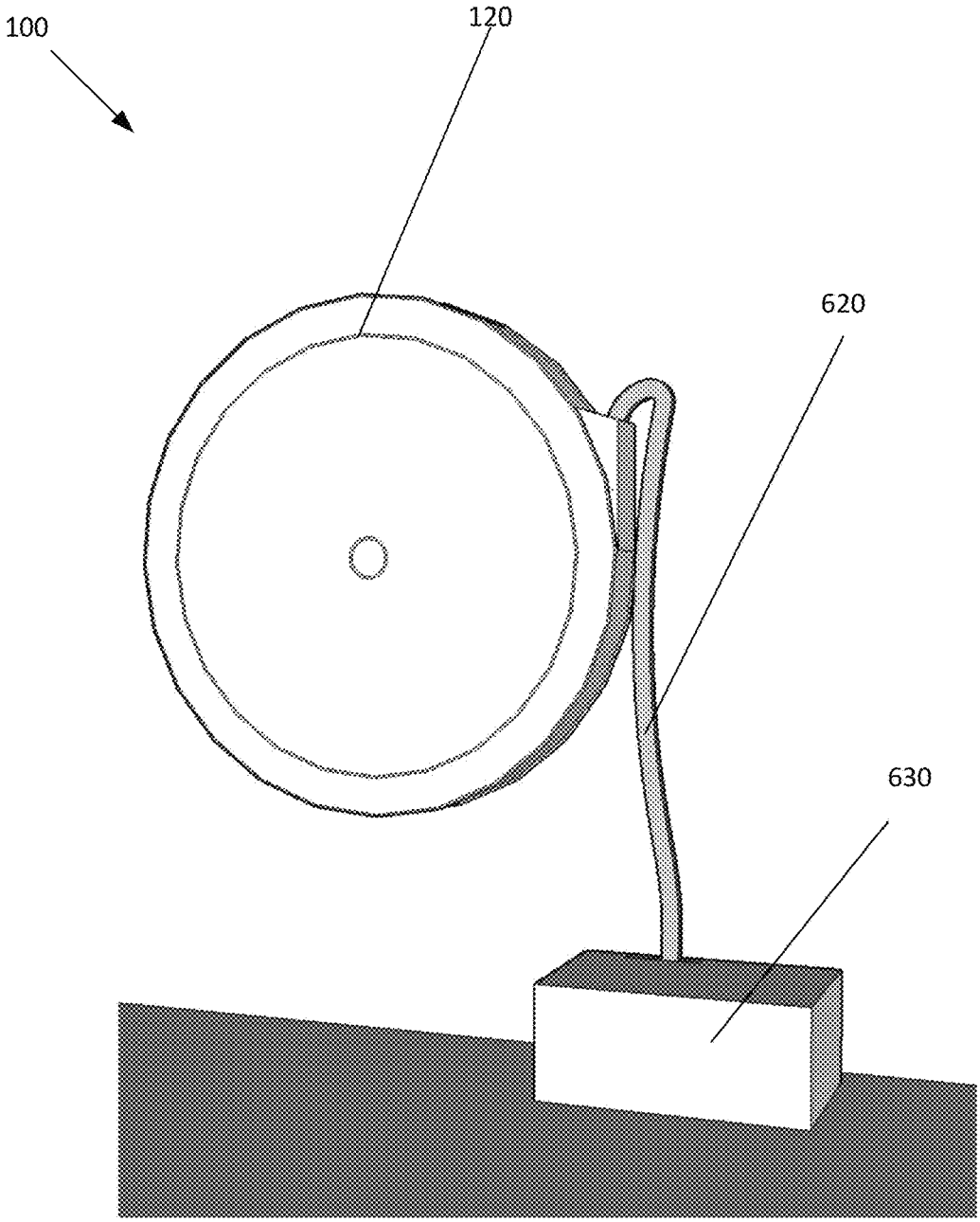
FIG. 7 depicts a front view of an autonomous pool cleaning system mounted on the sidewall of a pool, according to an embodiment.

FIG. 7 depicts a front view of system 100 mounted on the sidewall of a pool, according to an embodiment. Elements depicted in FIG. 7 may be described above, and for the sake of brevity a further description of the elements may be omitted.

Figure 8:
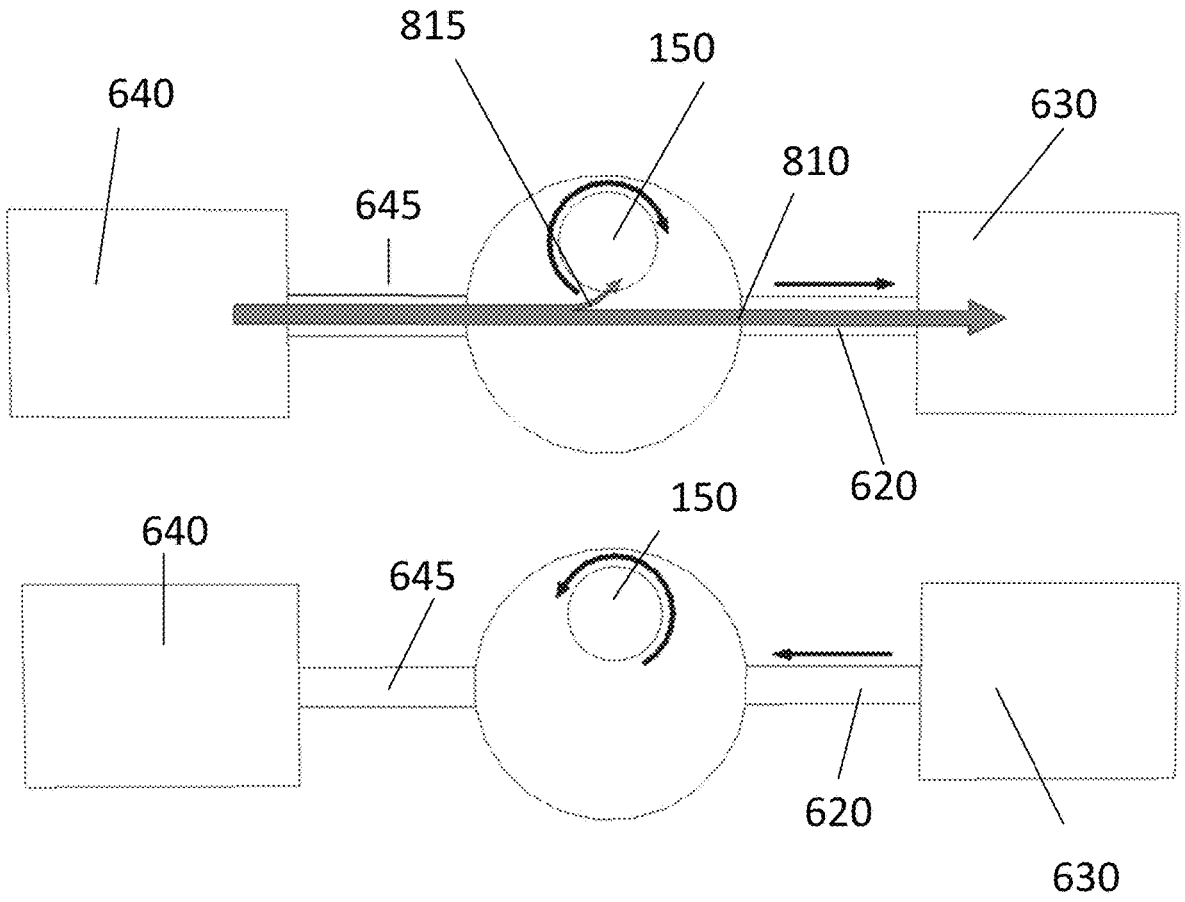
FIG. 8 depicts a diagram of fluid flowing to or from a pump through an autonomous pool cleaning system, according to an embodiment.

FIG. 8 depicts a diagram of fluid flowing 810 to or from pump 645 through system 100, according to an embodiment.

As depicted in FIG. 8, responsive to fluid flowing 810 to or from pump 640, a portion 815 of the energy associated with the flowing fluid 810 may be utilized by the turbine within the pool connector to coil spring 150. Furthermore, as the energy is being harvested by spring 150, the inner casing may rotate in a first direction, and allow more of hose 620 to be exposed within the pool.

Responsive to ceasing of the fluid flowing 810 to or from pump 640, spring 150 may release the stored energy. This may allow the inner casing to rotate in a second direction, and retract hose 620.

Figure 9:
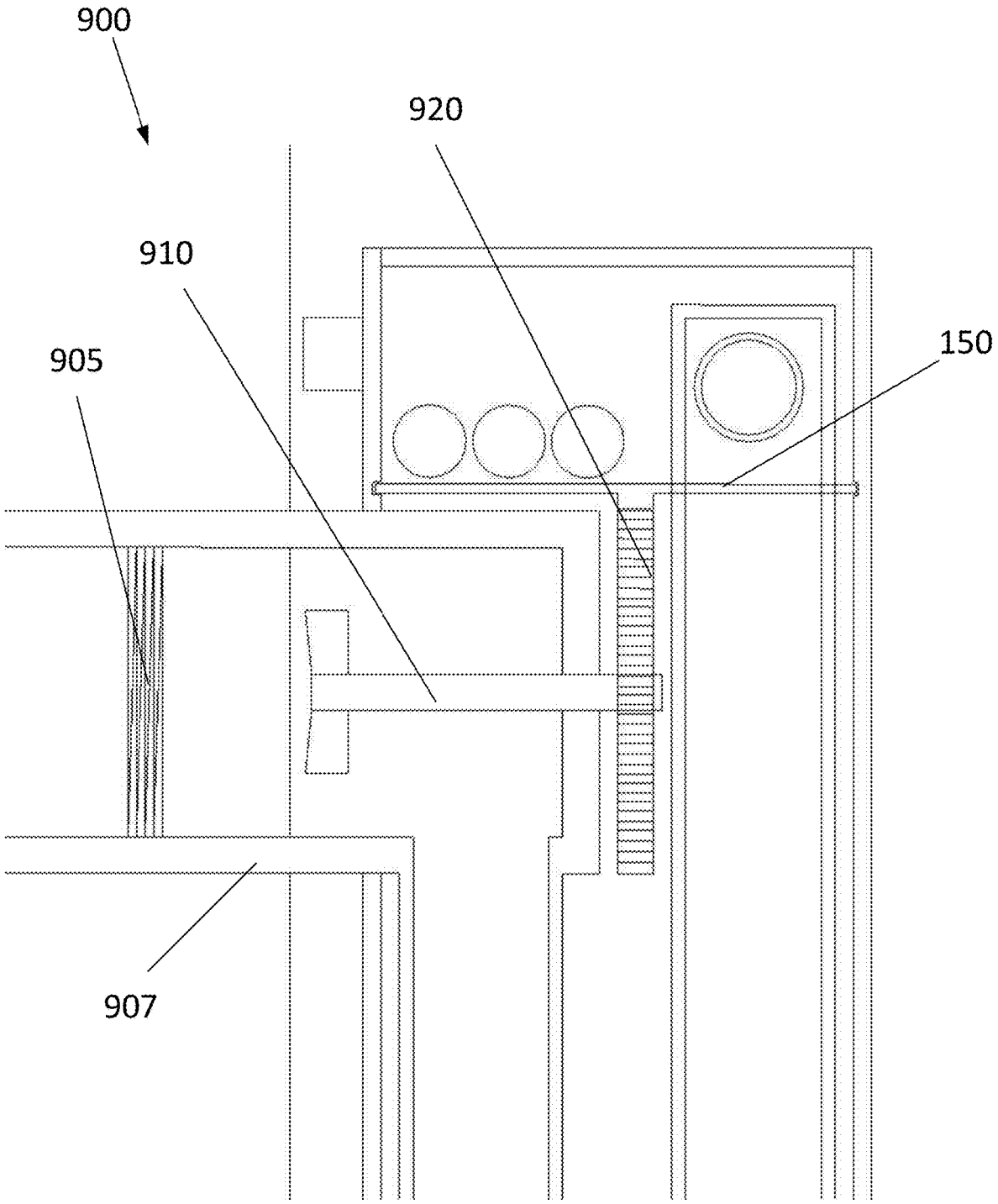
FIGS. 9-11 depict an alternative embodiment to automatically extend and retract a hose, according to embodiments.
Figure 10:
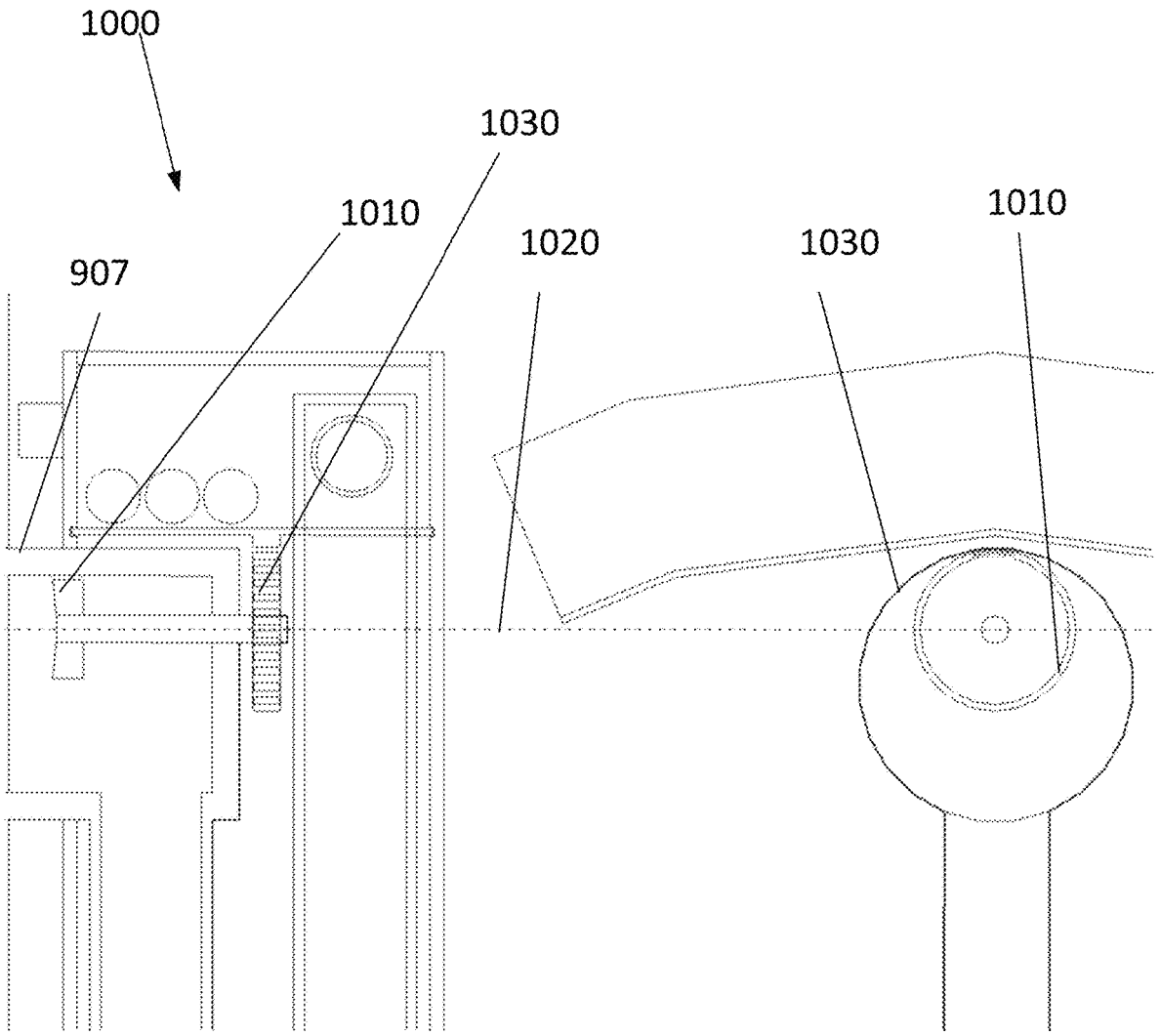
Figure 11:
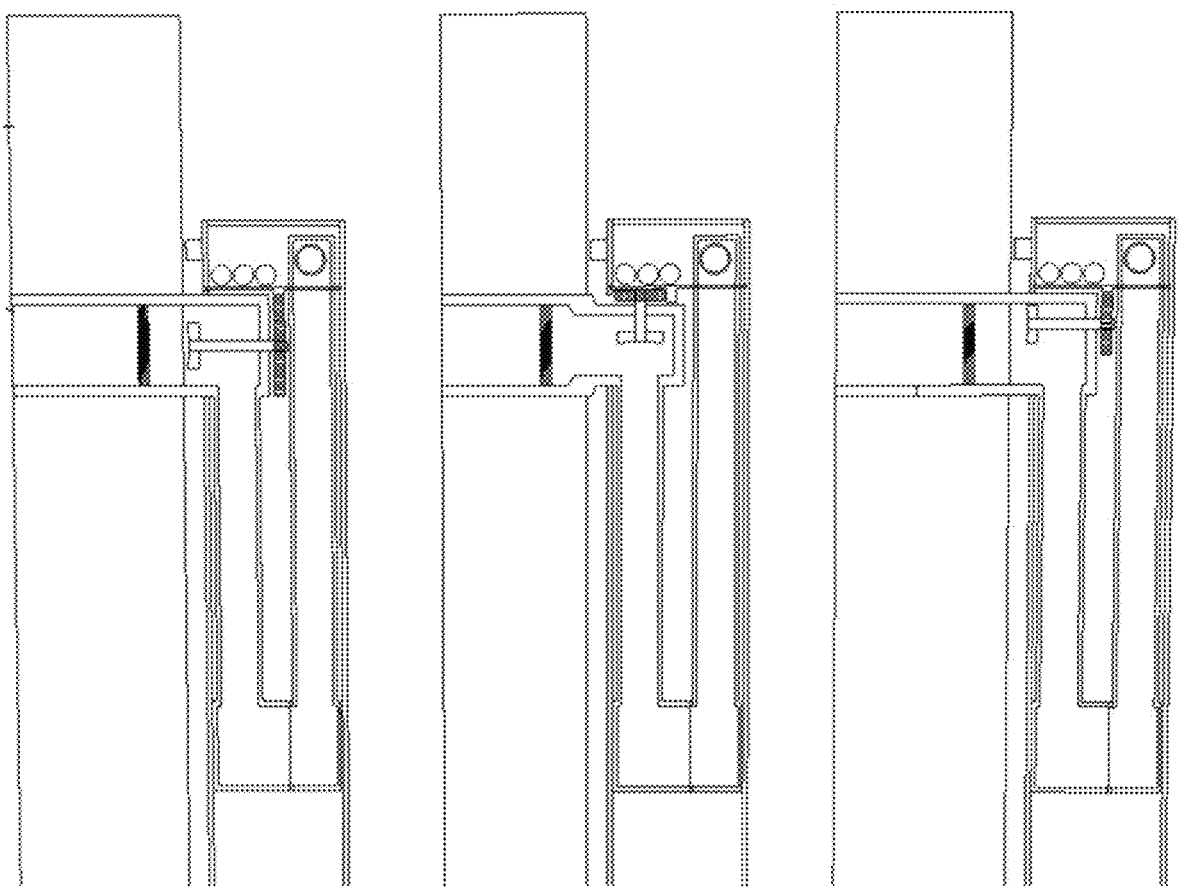

FIGS. 9-11 depict an alternative embodiment to automatically extend and retract a hose, according to embodiments. Elements described in these FIGURES may be described above, and for the sake of brevity an additional description of these elements may be omitted.

FIG. 9 depicts a side view of a pool connector 907 that is configured to allow fluid to flow between an inlet and an outlet of the pool connector 907. In embodiments, pool connector 907 may be configured to be coupled with a line via threads 905, wherein the line is also coupled with a pump.

As fluid flows through pool connector 907, the fluid may interact with a turbine 910, causing turbine 910 to rotate. The rotation of turbine 910 may cause gears 920 to rotate, which rotates inner casing 150.

FIG. 10 depicts a system with a nonconcentric turbine 1010 within pool connector 907. The nonconcentric turbine may allow for smaller gears 1030 to be used, while also limiting the energy capture of turbine 1010. More specifically, by not centrally positioning turbine 1010 within pool connector 907 less of the fluid flowing through pool connector 907 may interact with turbine 1010. This may allow more of the forces associated with the fluid flow to interact with the pool cleaner.

FIG. 11 depicts various layouts of turbines and gears within pool connectors. As depicted in the FIGURES, the orientation and positioning the turbines may be different.

Figure 12:
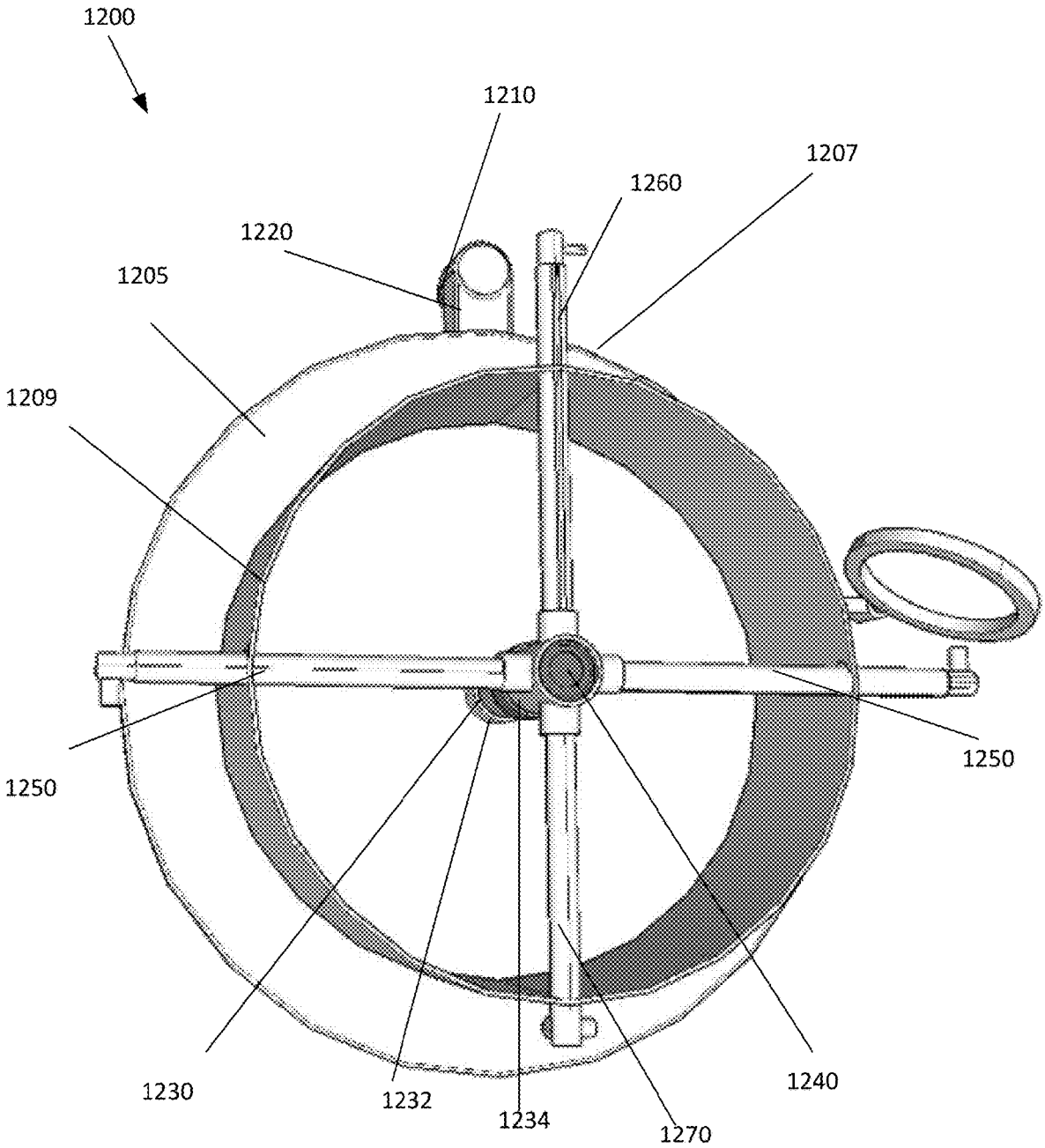
FIG. 12 depicts an autonomous pool cleaning system, according to an embodiment.

FIG. 12 depicts an autonomous pool cleaning system 1200, according to an embodiment. Elements depicted in FIG. 12 may be described above, and for the sake of brevity another description of these elements may be omitted. System 1200 may include drum 1205, pool connector 1210, supply line 1220, center pivot 1230, valve 1240, windings arms 1250, unwinding arm 1260, and hose connect arm 1270.

Drum 1205 may be a housing that is configured to be coupled with a line from a pool pump, and supply structural support to elements associated with system 1200. Drum 1205 may have a first face 1207 that is configured to be flush mounted onto the sidewall of a pool while being submerged in water, positioned within a recess within of a pool, or be positioned on or within a deck of the pool. Drum 1205 may also include rotating face 1209. Rotating face 1209 may be positioned away from first face 1207 to create an annular space within drum 1205, wherein a hose may be stored within the annular space. First face 1207 and rotating face 1209 may be configured to rotate together in two directions, which may assist in winding and unwinding the hose.

Pool connector 1210 may be a channel within drum first face 1207 that is configured to receive fluid from the pool pump, and transfer the fluid to the hose. Pool connector 1210 may have a central axis that extends in a plane orthogonal to a sidewall of the pool.

Supply line 1220 may be a channel, conduit, etc. that is configured to transfer fluid between pool connector 1210 and center pivot 1230. Supply line 1220 may have a central axis that extends in parallel to the sidewall of the pool.

Center pivot 1230 may be centrally positioned within housing between first face 1207 and rotating face 1209. Center pivot 1230 may have configured to provide an axis of rotation for rotating face 1209. Center pivot 1230 may include a first portion 1232 and a ported outlet 1234.

First portion 1232 may be directly coupled to supply line 1220, and be configured to be fixed in place. First portion 1232 may be a conduit to ported outlet 1234.

Ported outlet 1234 be a conduit, channel, etc. that is substantially tubular in shape. Ported outlet 1234 may be configured to be coupled to a first portion 1232 of the center pivot 1230, and also be configured to rotate based on hydraulic forces and the positioning of valve 1240. Ported outlet 1234 may have a plurality of outlet ports that extend from an inner circumference of the ported outlet to the outer circumference of the ported outlet. In embodiments, two of the plurality of the ports may be coupled to the winding arms 1250, one of the plurality of ports may be coupled to the unwinding arm 1260, and one of the plurality of ports may be coupled to hose connect arm 1270. In embodiments, valve 1240 may be configured to selectively cover some, but not all, of the plurality of ports.

Valve 1240 may be a device with a closed end and an open end that is configured to be positioned within center pivot 1230. Valve 1240 may have a plurality of ports that extend through a circumference of valve, wherein the plurality of ports within valve 1240 have a similar diameter to those of ported outlet 1234. In embodiments, valve 1240 may have a fewer number of ports than ported outlet 1234. For example, valve 1240 may have two outlets and ported outlet 1234 may have four outlets. Valve 1240 may be configured to rotate to be in a first mode to selectively align its ports with ports associated with windings arms 1250. Valve 1240 may also be configured to rotate to be in a second mode to selectively align its ports with ports associated with unwinding arm 1260 and hose connect arm 1270.

In embodiments, valve 1240 may be configured to change between the first mode and the second mode based in part on ceasing the flow of fluid through center pivot, and subsequently flowing fluid through center pivot 1230 in a first direction. As such, the transition between modes does not require hydraulic forces acting upon valve 1240 in a second direction. In embodiments, after transitioning valve 1240 between modes, valve 1240 may correspondingly rotate with ported outlet 1234. This may enable valve 1240 to be maintained in the first mode or the second mode until fluid ceases to flow through center pivot 1230. More specifically, ported outlet 1234 may be configured to allow valve 1240 to move linearly and rotate within ported outlet 1234 while ported outlet 1234 remains fixed in place. Ported outlet 1234 may be fixed in place when a spring force is greater than a hydraulic force. Additionally, ported outlet 1234 may be configured to rotate along with valve 1240 when the hydraulic force is greater than the spring force.

Windings arms 1250 may be projections extending away from center pivot 1230 in an axis that is orthogonal to a central axis of center pivot 1230. Windings arms 1250 may have jets that are configured to emit fluid in a first direction. When valve 1240 is in the first mode and to winding arms 1250 receive fluid, winding arms 1250 may emit fluid in the first direction, valve 1240, ported outlet 1234, unwinding arm 1260, hose connect arm 1270, and rotating face 1209 may rotate in the first direction. This may enable a hose coupled to hose connect arm 1270 to wind around center pivot 1230.

Windings arms 1250 may be projections extending away from center pivot 1230 in an axis that is orthogonal to a central axis of center pivot 1230. In other embodiments, winding arms 1250 may be conduits within rotating face 1209 extending away from center pivot 1230 in an axis that is orthogonal to the central axis of center pivot 1230. Windings arms 1250 may have jets that are configured to emit fluid to cause winding arm 1250 to rotate in a first direction. When valve 1240 is in the first mode and winding arms 1250 receive fluid, winding arms 1250 may emit fluid. This may cause ported outlet 1234, winding arms 1250, unwinding arm 1260, hose connect arm 1270, and rotating face 1209 to rotate in a first direction. This may enable a hose coupled to hose connect arm 1270 to wind around center pivot 1230.

Unwinding arm 1260 may be a projection extending away from center pivot 1230 in an axis that is orthogonal to the central axis of center pivot 1230. In other embodiments, unwinding arm 1260 may be a conduit within rotating face 1209 extending away from center pivot 1230 in an axis that is orthogonal to the central axis of center pivot 1230. Unwinding arm 1260 may have jets that are configured to emit fluid to rotate unwinding arm in a second direction. When valve 1240 is in the second mode and unwinding arm 1260 receive fluid, unwinding arm 1260 may emit fluid causing valve 1240, ported outlet 1234, winding arms 1250, unwinding arm 1260, hose connect arm 1270, and rotating face 1209 to rotate in a second direction. This may enable a hose coupled to hose connect arm 1270 to wind around center pivot 1230. In embodiments, a total cross sectional area associated with the jets of unwinding arm 1260 may be smaller than a total cross section area associated with the jets associated with winding arms 1270. This difference in cross sectional area may enable lower torque on system 100 when rotating in the second direction, while also allowing for a faster spool of the hose when system 100 is rotating in the first direction.

Hose connect arm 1270 may be a projection extending away from center pivot 1230 in an axis that is orthogonal to the central axis of center pivot 1230. In other embodiments, Hose connect arm 1270 may be a conduit within rotating face 1209 extending away from center pivot 1230 in an axis that is orthogonal to the central axis of center pivot 1230. Hose connect arm 1270 may have be configured to be coupled to a hose of a pool cleaner. Responsive to winding arm 1260 rotating system 100 in the first direction, the hose may become wound around center pivot 1230. Responsive to winding arm 1260 rotating system 100 in the second direction, the hose may become unwound, and the pool cleaner may move within the pool.

Figure 13:
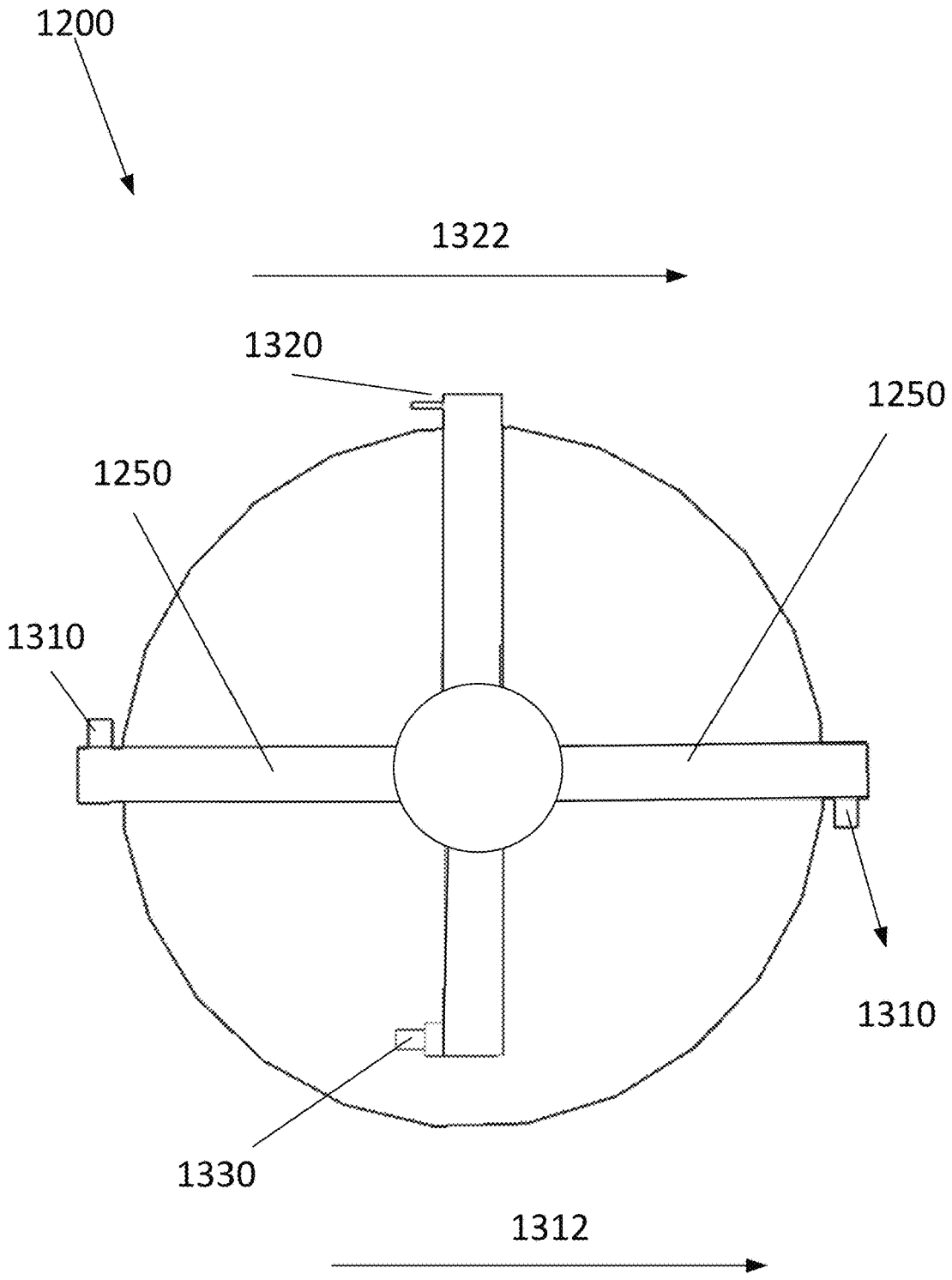
FIG. 13 depicts an autonomous pool cleaning system, according to an embodiment.

FIG. 13 depicts an autonomous pool cleaning system 1200, according to an embodiment. Elements depicted in FIG. 13 may be described above, and for the sake of brevity another description of these elements may be omitted.

As depicted in FIG. 13, jets 1310 positioned on winding arms 1250 may be configured to emit fluid to rotate system 1200 in a first direction 1312. The jet 1320 positioned on unwinding arm 1260 may be configured to emit fluid to rotate system 1200 in a second direction 1322. Accordingly, fluid emitted from the jets 1310, 1320 may be configured to rotate system 1200 in different directions, which may enable a single pool pump to create hydraulic forces to wind and unwind the hose 1330.

Figure 14:
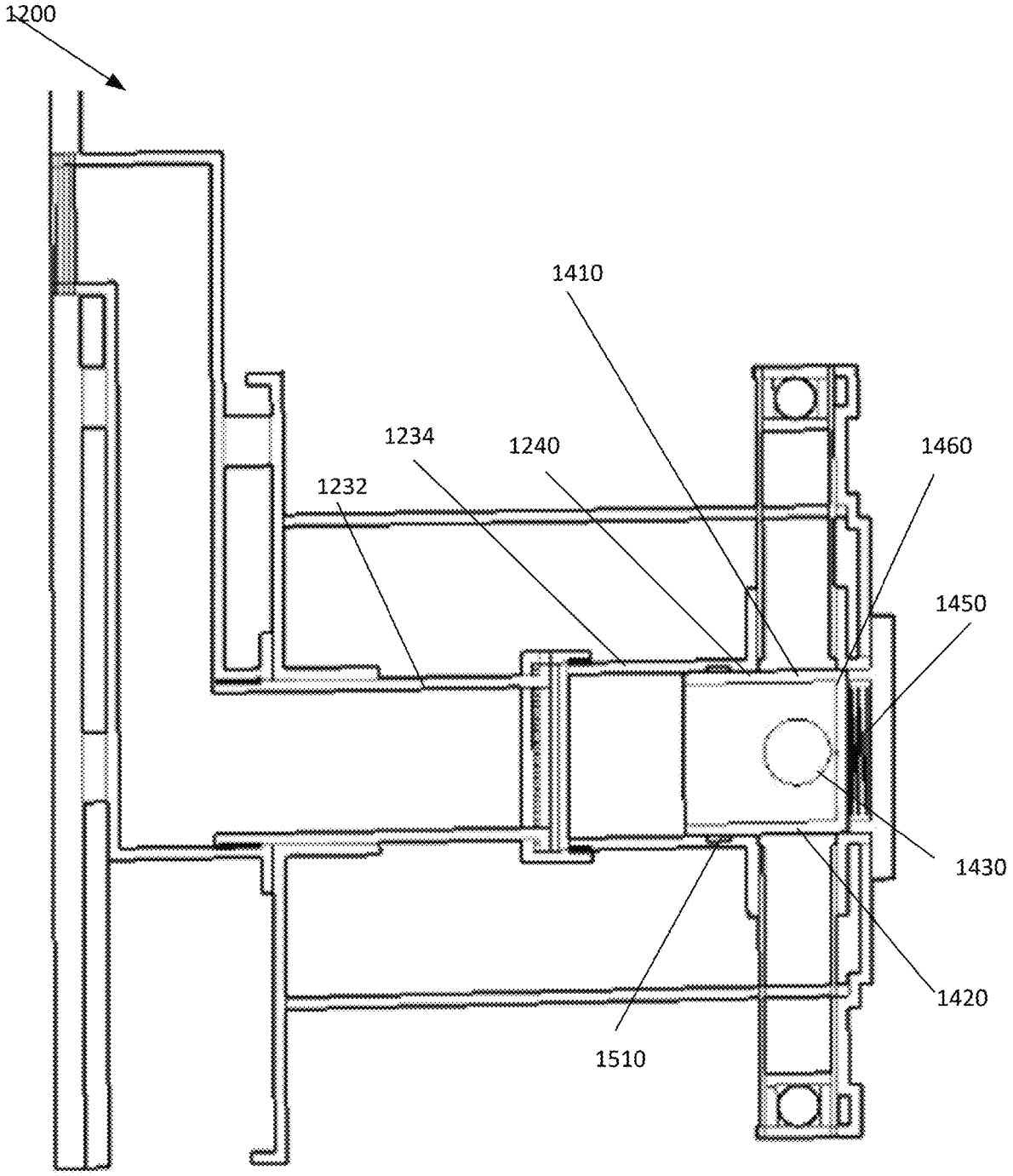
FIGS. 14 and 15 depict an autonomous pool cleaning system, according to an embodiment.
Figure 15:
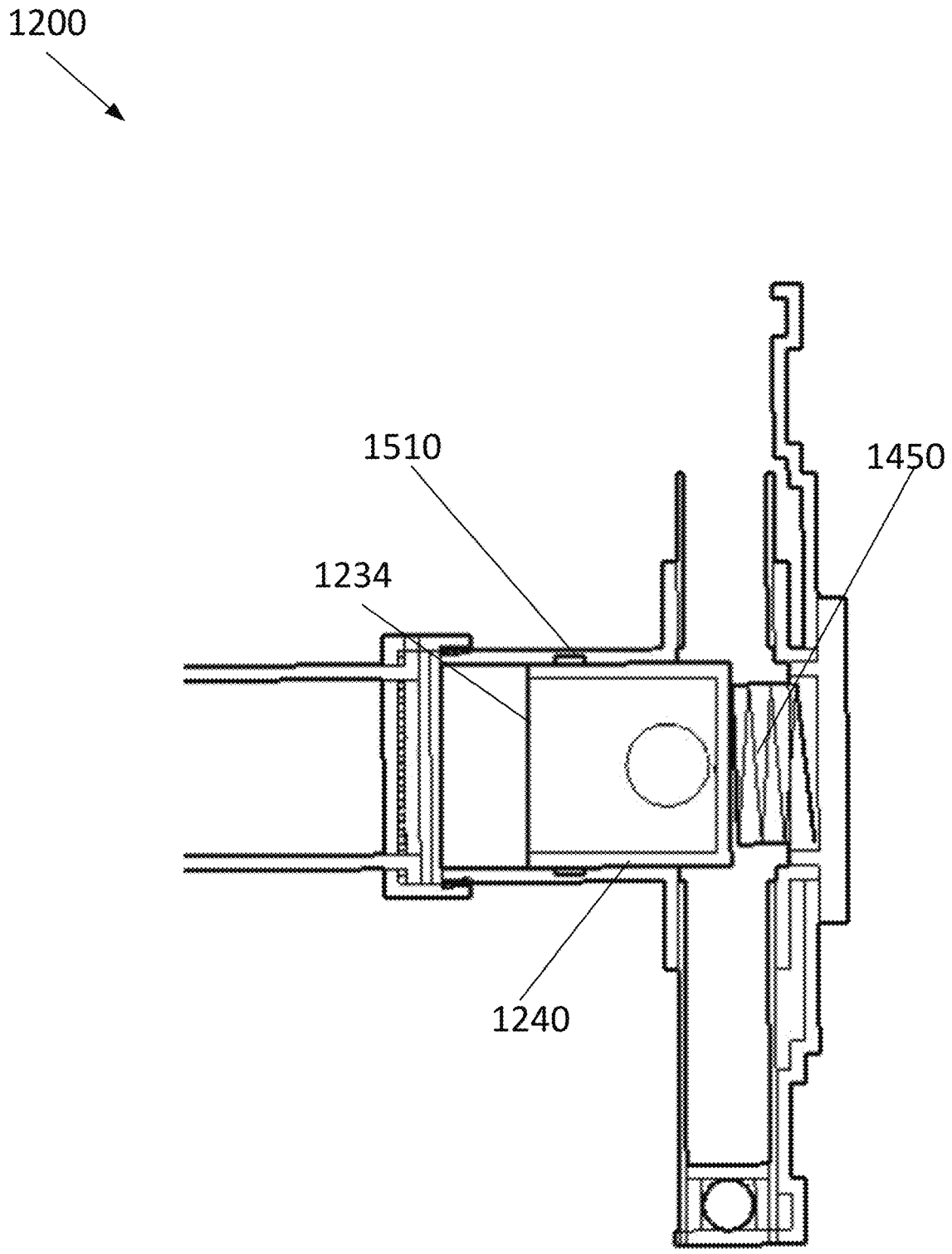

FIGS. 14 and 15 depict an autonomous pool cleaning system 1200, according to an embodiment. Elements depicted in FIG. 14 may be described above, and for the sake of brevity another description of these elements may be omitted.

As depicted in FIGS. 14 and 15, valve 1240 with two outlets may be configured to be positioned within ported outlet 1234 with four outlets. Based on the relative positioning of valve 1240 within ported outlet 1234, in a first position ports 1410 and 1420 associated with winding arms 1250 may be open, or in a second position port 1430 associated with unwinding arm 1260 and port 1440 associated with the hose connect may be open. Valve 1240 may be configured to move linearly and rotate relative to a static ported outlet 1234 to transition between the first mode and the second mode.

Furthermore, system 1200 may include a spring 1450 and pivot body grooves (not shown). Spring 1450 may be configured to exert a constant spring force against a closed face 1460 of valve 1240. When fluid is flowing through system 1200 and into valve 1240 from the pool pump, the hydraulic forces acting upon valve 1240 may be greater than the constant spring force, which may cause spring 1450 to compress and vertically align ports with valve 1240 with selected ports of ported outlet 1234. Responsive to ceasing the flow of fluid, the constant force may be greater than the hydraulic forces acting upon valve 1240. This may allow spring 1240 to elongate and a profile associated with an open face of valve 1240 to interface with a profile of pivot body grooves to rotate valve 1240 from the first mode to the second mode, or from the second mode to the first mode.

In other words in a first cycle, when water pressure beings acting on valve 1240 when valve 1240 is in a first mode, spring 1450 may compress and fluid may flow out of the winding arms 1250 to wind the hose. Next, fluid may cease flowing into valve 1240 causing spring 1450 to elongate, and interfacing the open end of valve 1240 to interface with the pivot body grooves. This may rotate valve ninety degrees to be in the second mode. When water pressure beings acting on valve 1240 when valve 1240 is in the second mode, spring 1450 may compress and fluid may flow out of the unwinding arm 1260 and hose connect arm 1270 to unwind the hose. Next, fluid may cease flowing into valve 1240 causing spring 1450 to elongate, and interfacing the open end of valve 1240 to interface with the pivot body grooves. This may rotate valve ninety degrees to be in the first mode.

Furthermore, pegs 1510, projections, etc. may be positioned on an outer circumference of valve 1240. The pegs may be configured to interface with the pivot body grooves within the ported outlet 1234 to rotate valve 1240.

Figure 16:
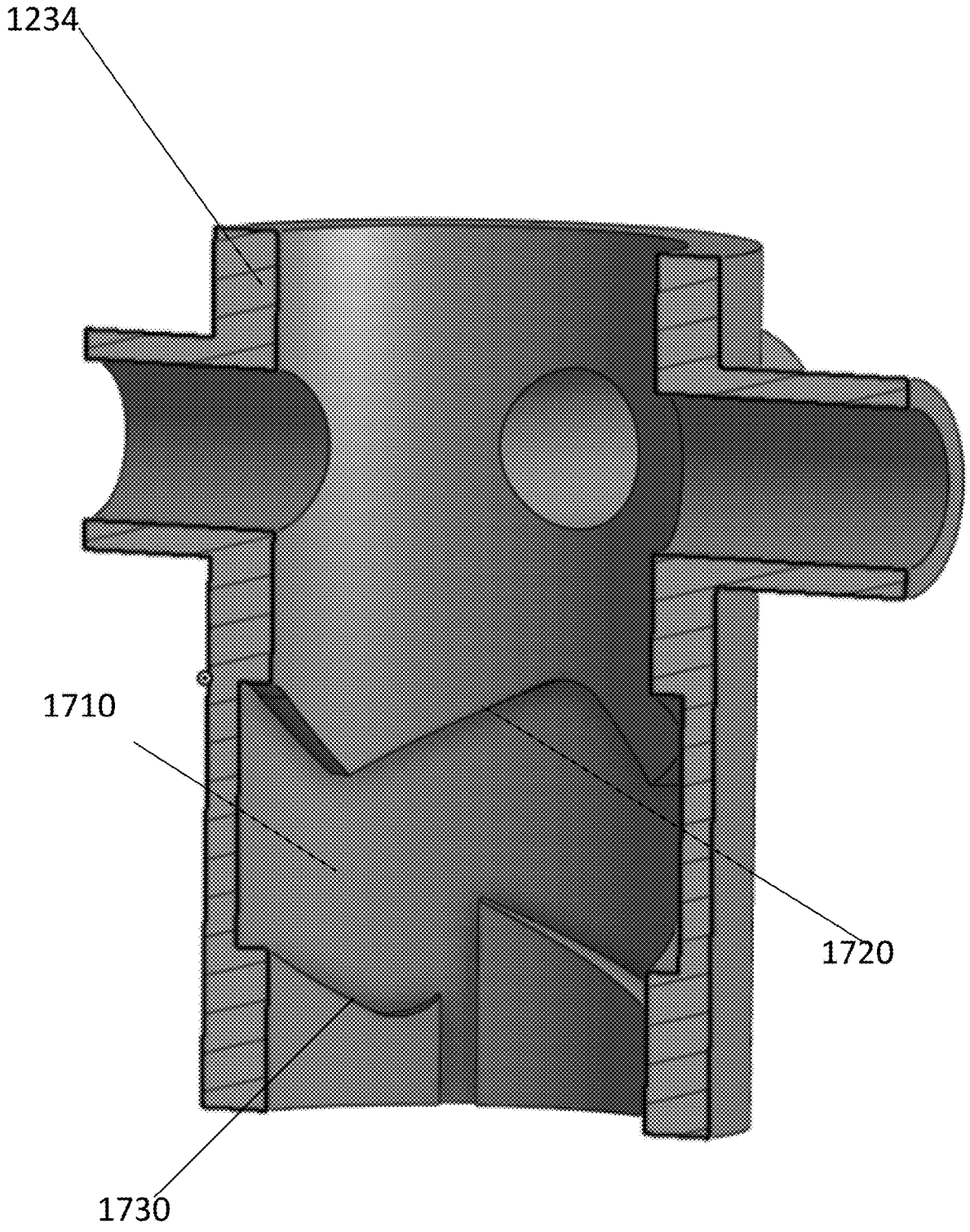
FIG. 16 depicts a ported outlet for an autonomous pool cleaning system, according to an embodiment.

FIG. 16 depicts a ported outlet 1234, according to an embodiment. Elements depicted in FIG. 16 may be described above, and for the sake of brevity another description of these elements may be omitted.

As depicted in FIG. 16, portlet outlet 1234 may include pivot body grooves 1710. Pivot body grooves 1710 may have an upper surface 1720 and a lower surface 1730. Both upper surface 1720 and lower surface 1730 may be slanted, angled, etc.

When the spring force applied against the valve in a first direction is greater than a hydraulic force applied to the valve in a second direction, the pegs 1510 associated with the valve may interface with the profile on the lower surface 1730 of pivot body grooves 1710. Due to the tapering of the lower surface 1730 and the pressure applied by the constant spring force, when pegs 1510 interface with lower surface 1730, the valve may rotate.

When the spring force applied against the valve in a first direction is less than a hydraulic force applied to the valve in a second direction, the pegs 1510 associated with the valve may interface with the profile on the upper surface 1720 of pivot body grooves 1710. Due to the tapering of the upper surface 1720 and the pressure applied by the hydraulic forces, when pegs 1510 interface with lower surface 1730, the valve may rotate.

More specifically, spring 1450 may be positioned adjacent to a closed face of valve 1240, and be configured to apply a constant spring force against the closed face of valve 1240. An upper surface of pivot body grooves 1610 may have a first profile that is configured to interface pegs 1510 of the open face of valve 1240 responsive to the constant spring force being greater than a hydraulic force applied to the closed face of valve 1240. Responsive to the constant spring force being greater than the hydraulic force applied to the closed face of valve 1240, spring 1450 may move valve 1240 in an opposite direction of the flow of fluid from the pump. This linear movement of valve 1240 will cause the pegs 1510 to interface with lower surface 1730, rotating the valve in a first direction while ported outlet 1234 remains static. This interfacing may rotate the valve 45 degrees. Responsive to reinitiating the flow of fluid in a direction opposite the constant spring force, the flow of fluid may cause linear movement of valve 1240 while pegs 1510 interface with the upper surface 1730 to rotate the valve another 45 degrees. This process may be similar to that of a retractable pen, and may be utilized to rotate the valve 1240 between the first mode and the second mode.

Figure 17:
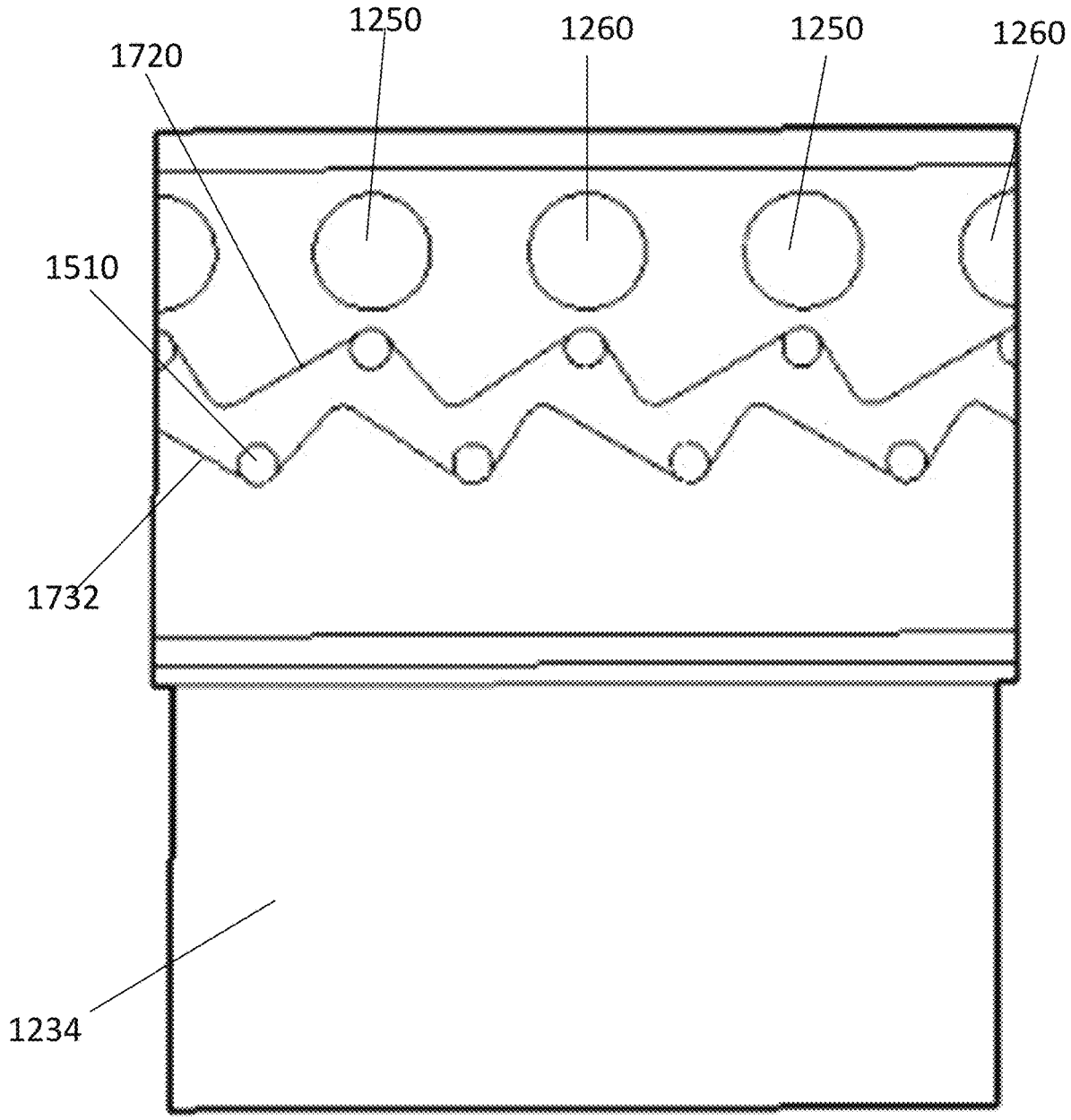
FIG. 17 depicts sequences associated with pegs interfacing with pivot body grooves, according to an embodiment.

FIG. 17 depicts sequences associated with pegs 1510 interfacing with pivot body grooves 1710, according to an embodiment. The sequences depicted in FIG. 17 may correspond to those illustrated in FIG. 18.

As depicted in FIG. 17, pegs 1510 may be configured to transition between being positioned adjacent to lower surfaces 1730 and upper surfaces 1720 based on a constant spring force and hydraulic forces being applied to the valve.

When the constant spring force is greater than the hydraulic forces, pegs 1510 may interface with lower surfaces 1730, sliding in a first rotational and first linear direction. When the constant spring force is less than the hydraulic forces, pegs 1510 may interface with upper surfaces 1720, sliding in the first rotational and a second linear direction. This rotational movement may allow the valve to selectively align its ports with the ports within ported outlet 1234.

Figure 18:
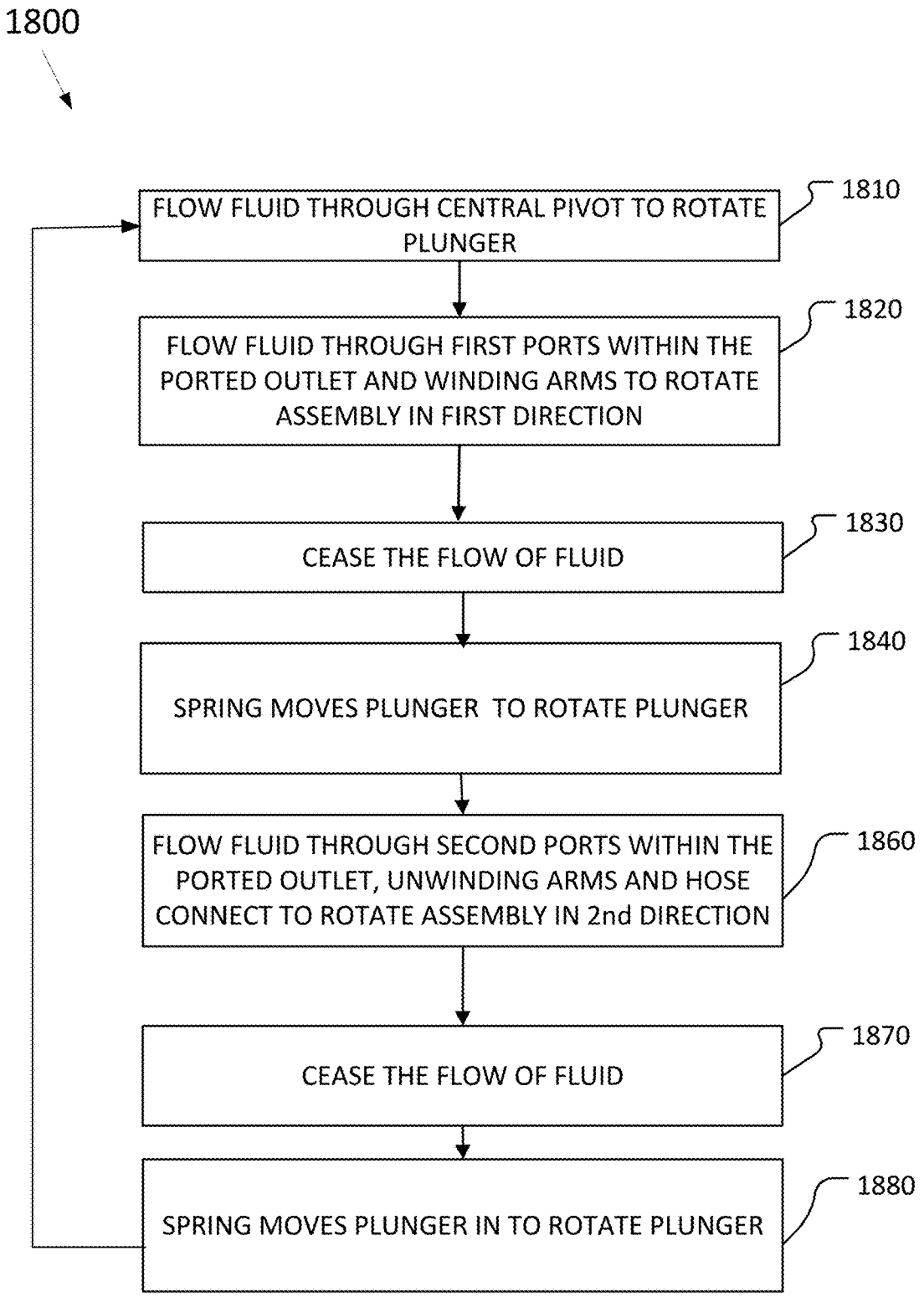
FIG. 18 depicts a method for utilizing an autonomous system associated with a pool cleaner, according to an embodiment.

FIG. 18 depicts a method 1800 for utilizing an autonomous system associated with a pool cleaner, according to an embodiment. The operations of method 1800 presented below are intended to be illustrative. In some embodiments, method 1800 may be accomplished with one or more additional operations not described, and/or without one or more of the operations discussed. Additionally, the order in which the operations of method 1800 are illustrated in FIG. 18 and described below is not intended to be limiting.

At operation 1810, fluid may flow through a central pivot in a first direction when the valve is in a first mode. The hydraulic forces applied by the flowing fluid against the valve may overcome a spring force. This may push pegs on an outer circumference of the valve against upper surfaces of pivot body grooves within a ported outlet, which rotates the valve. This rotation of the valve may move the valve from a second mode to a first mode.

At operation 1820, fluid may exit the central pivot through the ports in the valve and first ports within a ported outlet, while two other ports within the ported outlet remain sealed. The first set of ports receiving fluid may emit the fluid out of two jets associated with winding arms. This may rotate the assembly in a first direction to wind a hose, while the valve remains in the first mode rotating along with the ported outlet.

At operation 1830, fluid may cease flowing through the central pivot.

At operation 1840, a spring force acting upon the valve may push the valve in a second direction. This spring force may move pegs of the valve against lower surfaces of pivot body grooves within a fixed portion of the central pivot, which rotates the valve. This rotation of the valve may partially move the valve from a first mode to a second mode.

At operation 1850, fluid may flow through the central pivot in the first direction while the valve is in the second mode. The hydraulic forces applied by the flowing fluid against the valve may overcome the spring force. This may push the pegs of the valve against upper surfaces of pivot body grooves within the ported outlet, which rotates the valve. This rotation of the valve may fully move the valve from a first mode to a second mode.

At operation 1860, fluid may exit the central pivot through the ports in the valve and a second set of ports within a ported outlet, while the first set of ports within the ported outlet remain sealed. The second set of ports receiving fluid may emit the fluid out of two jets associated with a winding arm and a hose connect arm. This may rotate the assembly in a second direction to unwind the hose, while the valve and ported outlet remain in the second mode.

At operation 1870, fluid may cease flowing through the central pivot.

At operation 1880, responsive to ceasing flowing fluid the constant spring force applied by the spring acting upon the valve may push the pegs of the valve against lower surfaces of the pivot body grooves, which rotates the valve. This rotation of the valve may partially move the valve from the second mode to the first mode mode.

Figure 19:
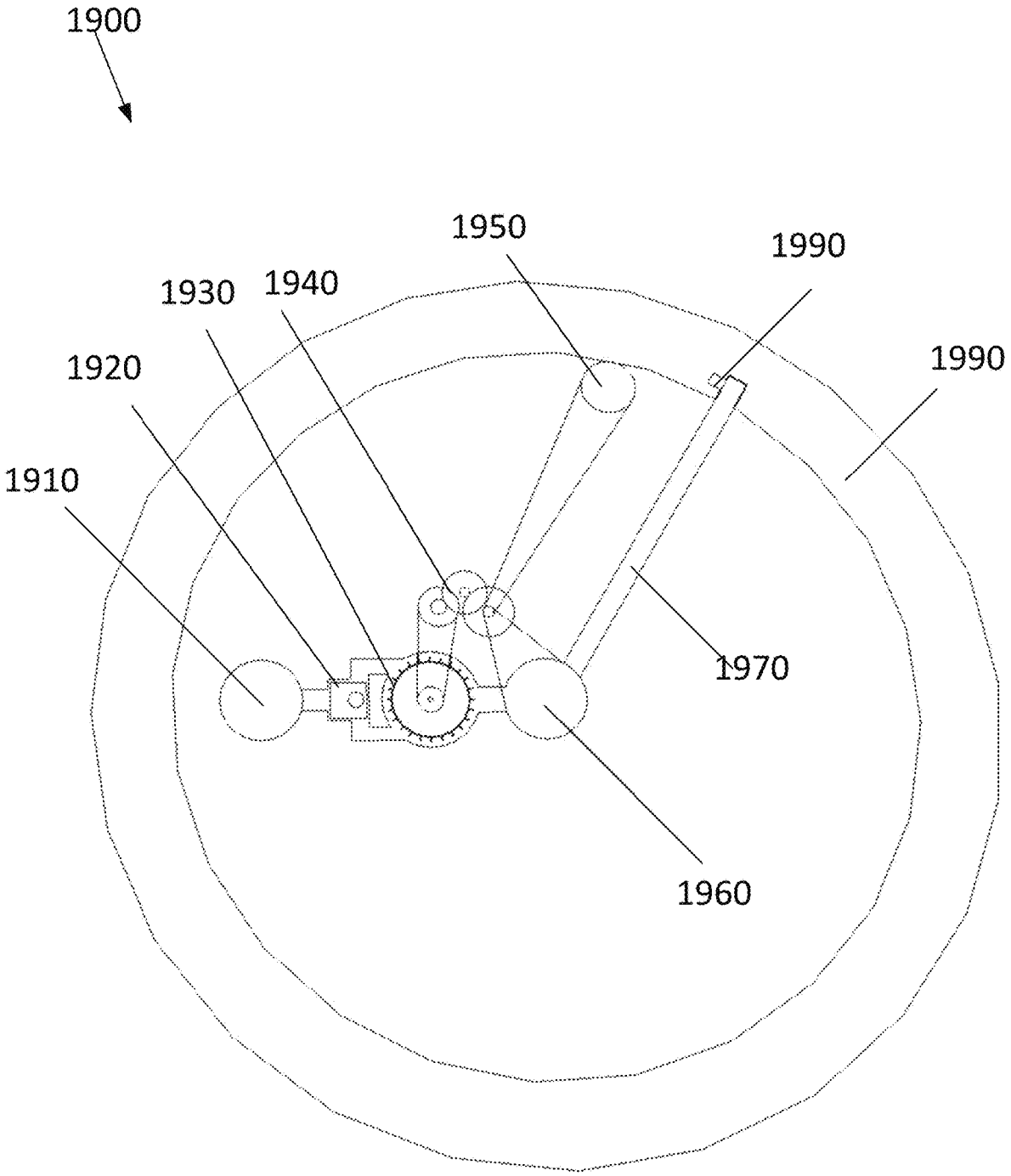
FIG. 19 depicts an autonomous pool cleaning system, according to an embodiment.

FIG. 19 depicts an autonomous pool cleaning system 1900, according to an embodiment. Elements depicted in FIG. 19 may be described above, and for the sake of brevity an additional description of these elements may be omitted.

As depicted in FIG. 19, system 1900 may include a pool wall connection 1910, an alternating valve 1920, turbine 1930, gears 1940, alternative gear interface 1950, center pivot 1960, supply arm 1970, hose connect 1980, hose storage drum 1990.

Pool wall connection 1910 may be configured to receive fluid via a pump, which may flow the received fluid to alternating valve 1920 in a similar manner to that of valve 1230. Alternating valve 1920 may be configured to rotate between a first mode to a second mode based on fluid flowing through alternating valve 1920 in a first direction, ceasing to flow through alternating valve 1920, and resuming flowing fluid through alternating valve 1930 in the first direction. In the first mode, alternating valve 1920 may have a port that is configured to supply fluid to turn turbine 1930 in clockwise. In the second mode, the port of alternating valve 1920 may be configured to supply fluid to turn turbine 1930 counter clockwise (or vice versa).

Responsive to turbine 1930 turning, turbine 1930 may correspondingly turn gears 1940, alternative gear interface 1950, or directly turn center pivot 1960. As such, when turbine 1930 rotates clockwise, turbine 1930 may directly or indirectly turn center pivot 1960 clockwise, and when turbine 1930 rotates counter clockwise, turbine 1930 may directly or indirectly turn center pivot counter clockwise.

The rotating of center pivot 1960 may correspondingly turn supply arm 1970 and hose connect 1980. This may enable center pivot 1960 to wind and unwind a hose within drum or hose storage 1990, which may be in an annular space outside of center pivot 1960. To this end, system 1900 may rotate supply arm 1970 in a forward and rearward direction based on flowing fluid in a single direction from pool wall connection 1910. By flowing fluid through valve 1920 at a flow rate less than a flow rate threshold and then increasing the flow rate through valve 1920 to be higher than the flow rate threshold, valve 1920 may change between the first mode and the second mode. This may correspondingly change a rotational direction of turbine 1930.

Figure 20:
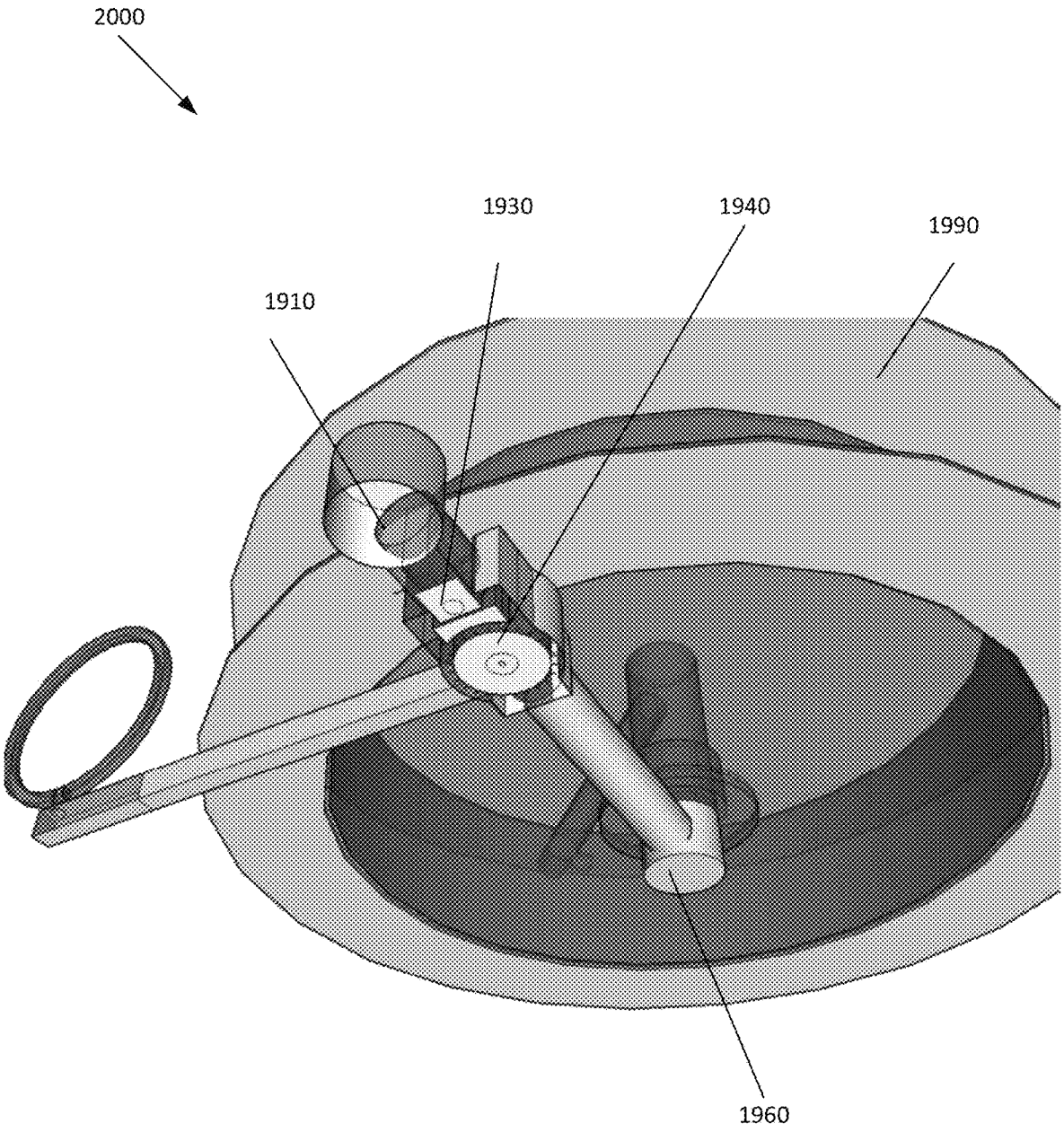
FIG. 20 depicts an autonomous pool cleaning system, according to an embodiment.

FIG. 20 depicts an autonomous pool cleaning system 2000, according to an embodiment. Elements depicted in FIG. 20 may be described above, and for the sake of brevity an additional description of these elements may be omitted.

As depicted in FIG. 20, pool wall connection 1910, alternating valve 1920, turbine 1930 may be externally positioned from drum 1990.

In other words, the alternating rotary valve 1920 may be configured to rotate to alternate flow to an opposite side of turbine 1930 on each on-off pump cycle from the pool pump. As the turbine 1930 rotates it engages with drum 1990 causing drum 1990 to rotate. Each successive pool pump-on off cycle may be configured to rotate valve 9120 to alternate the flow of turbine 1930 to alternate the flow of drum 1990 to wind and unwind a hose.

Figure 21:
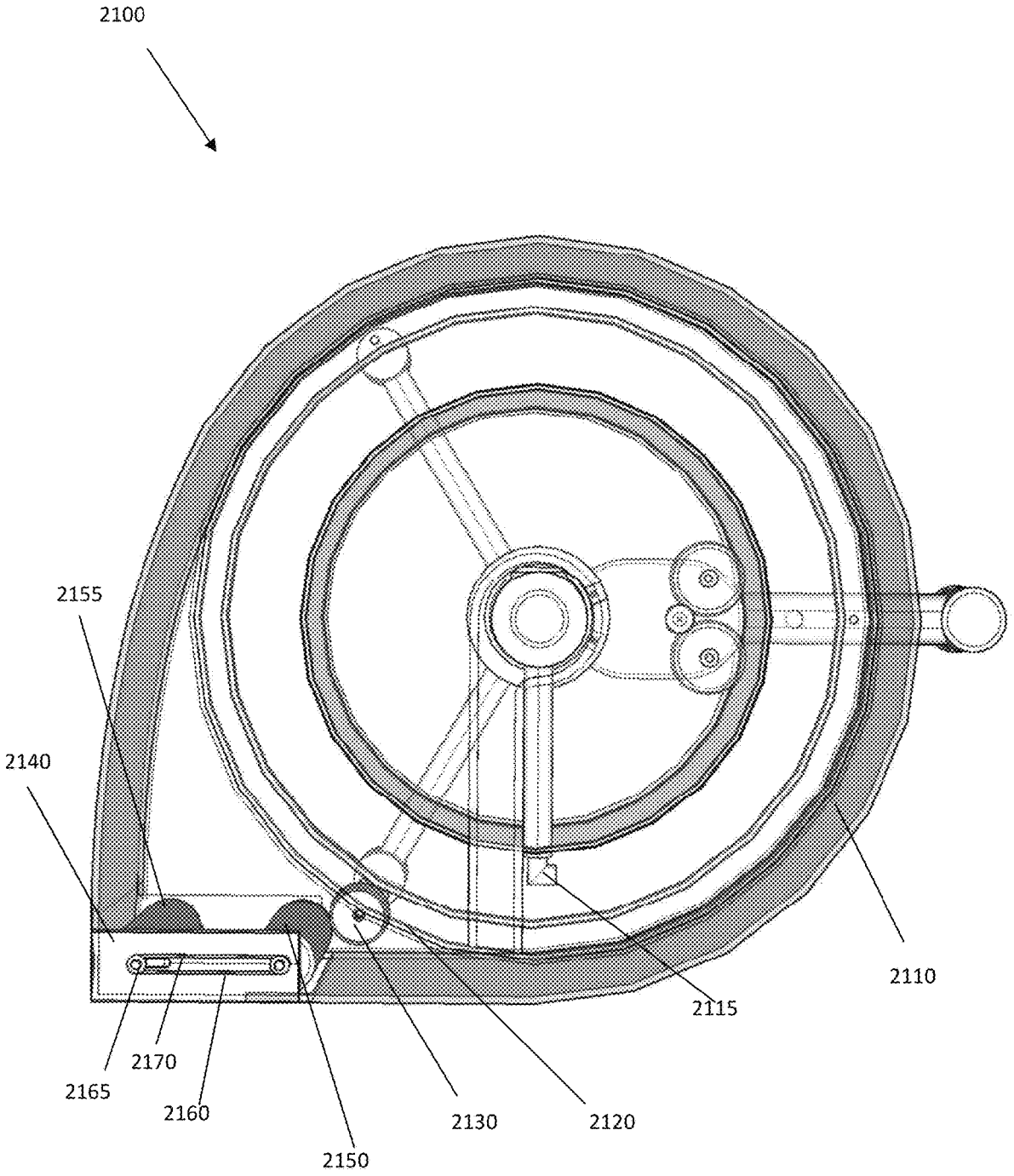
FIG. 21 depicts an autonomous pool cleaning system, according to an embodiment.

FIG. 21 depicts a system 2100 for controlling a tension of a hose while the hose is winding or unwinding, according to an embodiment. Elements depicted in FIG. 21 may be described above, and for the sake of brevity a further description of these elements may be omitted.

System 2100 may include a housing 2110, autonomous winding and unwinding system 2115, drum 2120, transfer gear 2130, hose control apparatus 2140, fixed roller 2150, tension roller 2155 with shaft 2165, tension device 2160, and slot 2170.

Housing 2110 may be a device that is configured to store and secure internal elements of hose control system 2100. Housing 2110 may be configured to be flush mounted on a deck or internal surface of a swimming pool.

Autonomous winding and unwinding system 2115 may be a device that is configured to wind and unwind a hose. In specific embodiments, winding and unwinding system 2115 may be configured to automatically rotate in a first direction to unwind a hose responsive to hydraulic pressure being pumped through winding and unwinding system 2115, wherein the same hydraulic pressure is utilized to move a pool robot. For example, responsive to pumping water through autonomous winding and unwinding system 2115, a hose reel may rotate in a second direction to be unwound, a pool vacuum may move, and system 2115 may store energy to later retract the hose. When water is no longer pumped through system 2115, the stored energy may automatically retract the hose.

Drum 2120 may be a cylindrical device that is configured to rotate based on autonomous winding and unwinding system 2115 rotating. In embodiments, when autonomous winding and unwinding system 2115 unwinds the hose, drum 2120 may rotate in a first rotational direction. When autonomous winding and unwinding system 2115 winds the hose, drum 2120 may rotate in a second rotational direction, wherein the first rotational direction is an opposite direction from the second rotational direction. An outer edge of drum 2120 may include an outer gear ring that is configured to directly interface with transfer gear 2130. The outer gear ring may include a first set of teeth that are configured to transfer torque from drum 2120 to transfer gear 2130.

Transfer gear 2130 may be a mechanical device that is configured to receive torque from drum 2120 and transfer that torque to fixed roller 2150. Transfer gear 2130 may have a second set of teeth that are configured to interface with the first set of teeth on the outer circumference of drum 2120. In embodiments, transfer gear 2130 may be mechanically positioned between drum 2120 and fixed roller 2150 to directly transfer the torque between drum 2120 and fixed roller 2150. Responsive drum 2120 rotating in a first direction, transfer gear 2130 may rotate in a second direction, causing fixed roller 2150 to rotate in the first direction. Responsive drum 2120 rotating in the second direction, transfer gear 2130 may rotate in the first direction, causing fixed roller 2150 to rotate in the second direction.

Hose control apparatus 2140 may be a device that is configured to control the tension of the hose within housing 1210. By creating constant tension against the hose while the hose is winding and unwinding, the hose will not become uncoiled within the housing 1210 while winding or unwinding. Furthermore, by controlling the tension of the hose, hose control apparatus 2140 may more smoothly allow the hose to become coiled and uncoiled. Hose control apparatus 2140 may include fixed roller 2150, tension roller 2155 with shaft 2165, tension device 2160, and slot 2170.

Fixed roller 2150 may be a roller that is configured to be fixed in place along a longitudinal and lateral axis of hose control apparatus 2140, while rotating based on torque received from transfer gear 2130. In embodiments, fixed roller 2150 may be positioned closer to a center of drum 2120 than tension roller 2155. Responsive to fixed roller 2150 rotating, these rotational forces may be transferred to the hose, which may assist in winding or unwinding the hose. In embodiments, the rotational forces applied by fixed roller 2150 may correspond and correlate to the forces applied to the hose from autonomous winding and unwinding system 2115.

Tension roller 2155 may be roller with a rotational axis that is configured to move along the longitudinal axis of hose control apparatus 2140 via tension device 2160 and slot 2170 while fixed roller 2150 remains fixed in place along the longitudinal axis of hose control apparatus 2140.

Tension roller 2155 may be a roller that is configured to rotate independently from fixed roller 2150. Responsive to decreasing a distance between tension roller 2155 and fixed roller 2150 more tension may be applied to the hose as the hose is unwinding and winding. Responsive to increasing a distance between tension roller 2155 and fixed roller 2150 less tension may be applied to the hose as the hose is unwinding and winding. The tension applied to the hose may be based on an amount of fluid pressure being exerted through the hose, which may increase the diameter across the hose, and an amount of compression force applied to tension roller 2155 via tension device 2160, wherein tension device 2160 may be configured to apply a fixed amount of force against tension roller 2155.

In embodiments, tension device 2160 may be a spring, elastic band, coil, hydraulic arm, or any other device that is configured to apply a constant amount of force against tension roller 2155 to move tension roller 2155 along the longitudinal axis of hose control apparatus 2140. In embodiments, a first end of the tension device 2160 may be coupled to the fixed roller 2150 and a second end of the tension device 2160 may be coupled to the tension roller 2155. This fixed amount of force may cause tension roller 2155 and fixed roller 2150 to apply continuous forces to the outer circumference of the hose, which may maintain the hose in tension while winding an unwinding, wherein the forces to move the hose through hose control apparatus 2140 via fixed roller 2155 may be the same hydraulic forces that wind and unwind autonomous winding and unwinding system 2115.

Slot 2170 may be a slot that extends along a longitudinal axis, which enables the movement of tension roller 2155 along the longitudinal axis of hose control apparatus 2140. In embodiments, tension roller 2155 may have a shaft that extends past the later axis of the roller, which may be inserted into the slot 2170. The shaft inserted through both the roller and slot may enable longitudinal movement along slot 2170. In embodiments, slot 2170 may extend along a plane that is orthogonal to a movement of the hose through hose control apparatus 2140.

Figure 22:
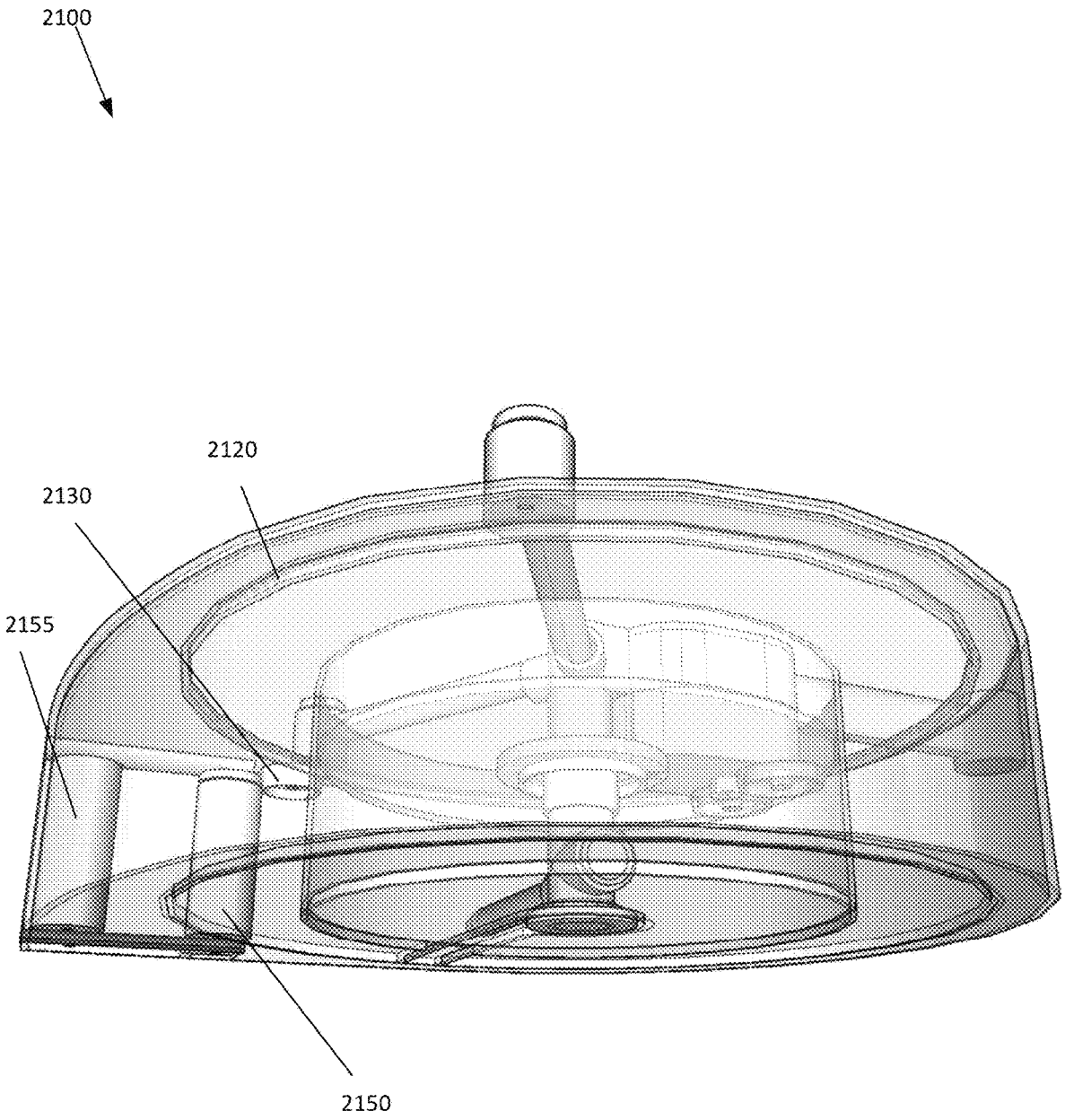
FIG. 22 depicts an autonomous pool cleaning system, according to an embodiment.

FIG. 22 depict alternative views of system 2100 for controlling a tension of a hose while the hose is winding or unwinding, according to an embodiment. Elements depicted in FIG. 22 may be described above, and for the sake of brevity a further description of these elements may be omitted.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

The invention claimed is:

1. A self-contained hose reel for a pool comprising:
a housing;
a valve positioned within the housing, the valve configured to change between a first mode and a second mode based on fluid flowing through the valve;
a drum configured to move a hose, wherein the drum rotates in a first direction when the valve is in the first mode, and the drum rotates in a second direction when the valve is in the second mode, the housing, the valve, and the drum are configured to be positioned within the pool, the valve being positioned centrally within the drum and the fluid flows through the valve within the drum in an axis perpendicular to the rotation of the rotation of the drum.

2. The self-contained hose reel of claim 1, wherein the valve is configured to be static while a pool vacuum moves, wherein the valve is configured to allow flow to a pool vacuum.

3. The self-contained hose reel of claim 1, wherein the hose rotates in the first direction when the valve is in the first mode, and in the second direction when the valve is in the second mode.

4. The self-contained hose reel of claim 3, further comprising:
an annular space positioned between the drum and an inner surface of the housing, wherein the hose is wound and unwound in the annular space, the hose being positioned within the annular space when the fluid flows through the valve and the hose to transition the valve between the first mode and the second mode.

5. The self-contained hose reel of claim 3, further comprising:
a transfer gear configured to rotate based on the drum rotating.

6. The self-contained hose reel of claim 5, further comprising:
a first roller and a second roller, wherein the transfer gear is configured to maintain the hose under tension, the first roller and the second roller being positioned outside of an annular space.

7. The self-contained hose reel of claim 1, wherein the valve is configured to switch from the second mode to the first mode based on stopping the flowing fluid through an inlet port.

8. The self-contained hose reel of claim 1, wherein the valve changes between the first mode and the second mode based on hydraulic pressure rotating the valve.

9. The self-contained hose reel of claim 1, wherein the valve is controlled by an external water supply, the housing include a first face and a second face, wherein the first face of the housing is positioned directly adjacent to a vertical sidewall of the pool.

10. The self-contained hose reel further of claim 1, further comprising:

a bidirectional turbine, and a gearbox configured to autonomously wind and unwind the hose, wherein the valve is a three mode valve.

* * * * *